US006419526B1

(12) United States Patent
Fair et al.

(10) Patent No.: US 6,419,526 B1
(45) Date of Patent: Jul. 16, 2002

(54) HIGH FREQUENCY BI-LEVEL OFFSET MULTI-PORT JACK

(75) Inventors: Mervin Fair, *deceased*, late of Glen Rock, by Judith S. Fair; Jeffrey Fleming, York; Ronald Locati, York; David Barnum, York; James Smith, York; Patrick Hulbert, New Providence; Richard Marowsky, York, all of PA (US)

(73) Assignee: Stewart Connector Systems, Inc., Glen Rock, PA (US)

( * ) Notice: Subject to any disclaimer, the term of this patent is extended or adjusted under 35 U.S.C. 154(b) by 0 days.

(21) Appl. No.: 09/169,627

(22) Filed: Oct. 9, 1998

Related U.S. Application Data

(60) Provisional application No. 60/061,466, filed on Oct. 9, 1997.

(51) Int. Cl.[7] ..... H01R 24/00

(52) U.S. Cl. ..... 439/676; 439/206; 439/941; 439/954

(58) Field of Search ..... 439/676, 701, 439/541.5, 922, 941, 206, 954

(56) References Cited

U.S. PATENT DOCUMENTS

| | | | | | |
|---|---|---|---|---|---|
| 4,220,391 | A | | 9/1980 | Krolak et al. | 339/126 R |
| 4,313,147 | A | * | 1/1982 | Uchida et al. | 361/119 |
| 4,734,043 | A | | 3/1988 | Emert et al. | 439/65 |
| 4,767,338 | A | | 8/1988 | Dennis et al. | 439/55 |
| 4,993,970 | A | | 2/1991 | Littrell | 439/535 |
| 5,078,609 | A | | 1/1992 | Bouchan et al. | 439/43 |
| 5,145,380 | A | | 9/1992 | Holcomb et al. | 439/49 |
| 5,167,530 | A | | 12/1992 | Wallgren et al. | 439/540 |
| 5,178,554 | A | * | 1/1993 | Siemon et al. | 439/188 |
| 5,362,257 | A | | 11/1994 | Neal et al. | 439/676 |
| 5,531,612 | A | | 7/1996 | Goodall et al. | 439/541.5 |
| 5,554,050 | A | * | 9/1996 | Marpoe et al. | 439/620 |
| 5,562,507 | A | | 10/1996 | Kan | 439/676 |
| 5,639,267 | A | | 6/1997 | Loudermilk | 439/701 |
| 5,773,763 | A | * | 6/1998 | Stachulla | 174/135 |
| 5,775,946 | A | * | 7/1998 | Briones | 439/607 |
| 6,068,520 | A | * | 5/2000 | Winings et al. | 439/676 |

* cited by examiner

*Primary Examiner*—Brian Sircus
*Assistant Examiner*—Michael C. Zarroli
(74) *Attorney, Agent, or Firm*—Steinberg & Raskin, P.C.

(57) ABSTRACT

A multi-port modular jack including an outer housing part, inner housing parts arranged in the outer housing part to define plug-receiving receptacles receivable of mating plugs, and an optional shield surrounding the jack. The outer housing part having a top wall, a bottom wall and a front face having a mid-portion arranged substantially parallel to and between the top and bottom walls. The front face defines a first row of apertures between the mid-portion and the top wall and a second row of apertures between the mid-portion and the bottom wall. Each aperture in the first row has a plane of symmetry offset in relation to a plane of symmetry of each aperture in the second row such that only a portion of each aperture in the first row is directly opposite the opposed apertures in the second row. Vents are formed in the outer housing part to allow for the passage of air through the jack. The inner housing parts are arranged in the outer housing part to define the plug-receiving receptacles in alignment with a respective aperture in the front face of the outer housing part. Each inner housing part includes contact/terminal members for engaging contacts of a plug insertable into a respective plug-receiving receptacle. The contact/terminal members forming one or more wire pairs may be provided with a double cross over to reduce near-end crosstalk.

29 Claims, 26 Drawing Sheets

FIG. 10
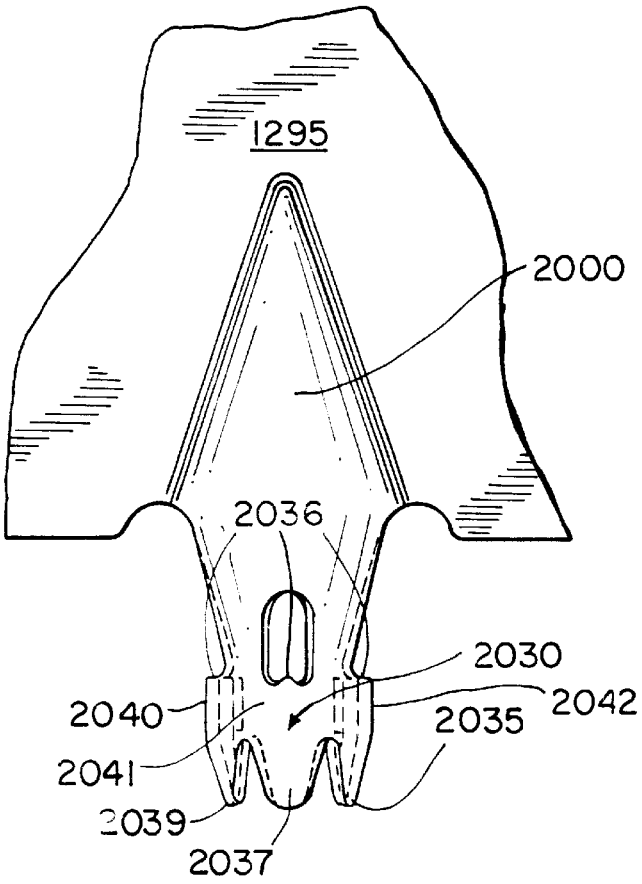
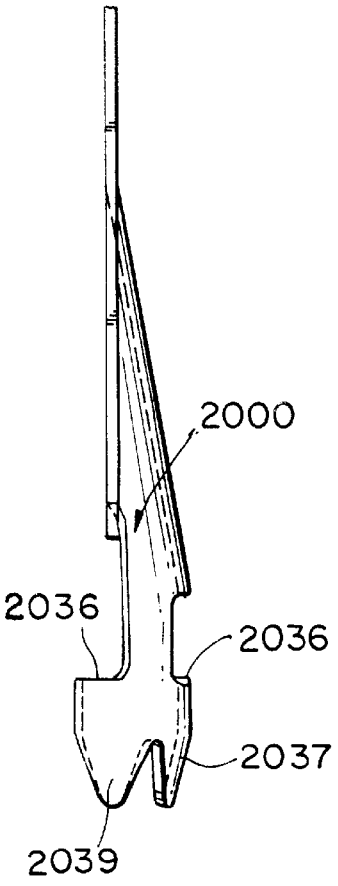
FIG. 9
FIG. 11
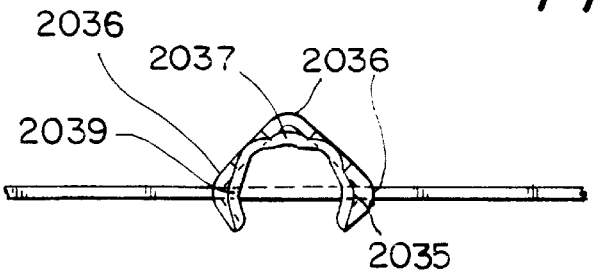

HIGH FREQUENCY BI-LEVEL OFFSET MULTI-PORT JACK

CROSS-REFERENCE TO RELATED APPLICATION

This application is related to U.S. provisional patent application Serial No. 60/061,466 filed Oct. 9, 1997.

FIELD OF THE INVENTION

The present invention relates to the field of modular connectors and more particularly, to the field of multi-port jacks.

BACKGROUND OF THE INVENTION

Data communication networks are being developed which enable the flow of information to ever greater numbers of users at ever higher transmission rates. However, data transmitted at high rates in multi-pair data communication cables have an increased susceptibility to crosstalk, which often adversely affects the processing of the transmitted data. The problem of crosstalk in information networks increases as the frequency of the transmitted signals increases.

In the case of local area network (LAN) systems employing electrically distinct twisted wire pairs, crosstalk occurs when signal energy inadvertently "crosses" from one signal pair to another. The point at which the signal crosses or couples from one set of wires to another may be 1) within the connector or internal circuitry of the transmitting station, referred to as "near-end" crosstalk, 2) within the connector or internal circuitry of the receiving station, referred to as "far-end crosstalk", or 3) within the interconnecting cable.

Near-end crosstalk ("NEXT") is especially troublesome in the case of telecommunication connectors of the type specified in sub-part F of FCC part 68.500, commonly referred to as modular connectors. The EIA/TIA of ANSI has promulgated electrical specifications for near-end crosstalk isolation in network connectors to ensure that the connectors themselves do not compromise the overall performance of the unshielded twisted pair interconnect hardware typically used in LAN systems. The EIA/TIA Category 5 electrical specifications specify the minimum near-end crosstalk isolation for connectors used in 100 ohm unshielded twisted pair Ethernet type interconnects at speeds of up to 100 MHz.

While it is desirable to use modular connectors for data transmission for reasons of economy, convenience and standardization, such connectors generally comprise a plurality of electrical contacts and conductors that extend parallel and closely spaced to each other thereby creating the possibility of excessive near-end crosstalk at high frequencies.

In addition, as the size of electronic components has become reduced with advances in semiconductor technology, it has become increasingly necessary to increase the number of modular connector ports which can be mounted within a given area.

OBJECTS OF THE INVENTION

It is an object of the invention to provide new and improved modular jacks which operatively reduce near-end crosstalk.

It is another object of the invention to provide new and improved multi-level modular jacks which operatively reduces near-end crosstalk.

It is yet another object of the invention to provide new and improved multi-level jacks which enable the jacks to be placed one on top of another allowing easy insertion and removal of plugs into the jacks.

It is another object of the invention to provide new and improved jacks which include a dedicated vent passage to operatively allow for the passage of air through the jack.

It is still another object of the invention to provide new and improved jacks which define a recess receivable of a printed circuit board to thereby reduce the height extension of the jack above the circuit board to which it is mounted.

It is still another object of the invention to provide a new and improved insert for a jack.

It is still another object of the invention to provide a new and improved method for manufacturing inserts for a jack.

SUMMARY OF THE INVENTION

In order to achieve at least some of these objects, and others, in accordance with a first embodiment of the present invention, a bi-level offset multiple port jack is provided and includes an outer housing part having a top wall, a bottom wall and a front face having a mid-portion arranged substantially parallel to and between the top wall and the bottom wall, and inner housing parts. The front face of the outer housing part defines a first row of at least one aperture between the mid-portion and the top wall and a second row of at least one aperture between the mid-portion and the bottom wall. The aperture in the first row has a plane of symmetry offset in relation to a plane of symmetry of the aperture in the second row such that only a portion of the aperture in the first row is directly opposed to the aperture in the second row. The inner housing parts are arranged in the outer housing part to define plug-receiving receptacles with the outer housing part, each plug receiving receptacle is in alignment with a respective aperture in the front face of the outer housing part. Each inner housing part includes contact/terminal members for engaging contacts of a plug insertable into a respective one of the plug-receiving receptacles. Each of the plug-receiving receptacles has a top wall and a bottom wall and is configured to accept a modular type plug having a resilient latch. In accordance with this embodiment, the upper level plug receptacles are configured to receive a resilient latch of a modular type plug in their top wall, the lower level plug receptacles are configured to receive a resilient latch of a modular type plug in their bottom wall. With this configuration, if a second bi-level offset multiple port jack is mounted above or below a first bi-level offset multiple port jack, and modular plugs are inserted into the receptacles of the first and second jacks, the resilient latches of the plugs secured within the first jack will be offset with respect to the resilient latches of the plugs secured within the second (adjacent) jack, thereby allowing the first and second jacks to be mounted more closely together.

In accordance with a further embodiment of the bi-level offset multiple port jack in accordance with the invention, at least one vent is provided in the jack to allow air to flow from the face of the jack through to the components on a printed circuit board to which the jack is mounted. This configuration is particularly advantageous in applications in which the jack is mounted to a face plate of an enclosed housing.

The outer housing part may also include a forward bottom portion adjacent the front face, an upper back portion adjacent the top wall, a rearward bottom portion adjacent the upper back portion and a lower back portion extending between the forward and rearward bottom portions to thereby define a recess at a rear of the outer housing part extending between lateral walls. The recess is receivable of a printed circuit board. This provides an advantage of reducing the necessary height extension of a jack mounted on a PCB above the PCB.

In another embodiment of the invention, the contact/terminal members in each inner housing part include at least one pair of contact/terminal members operatively forming a wire pair which cross over one another. The contact/terminal members include a contact portion adapted to extend into the respective plug-receiving receptacle, a terminal portion adapted to be connected to a printed circuit board and an intermediate bridging portion extending between the contact portion and the terminal portion. The cross over of the contact/terminal members occurs in the intermediate portion. Also, a portion of the intermediate portion of one contact/terminal member of the crossover pair is situated in a first plane in the inner housing part and a portion the intermediate portion of the other contact/terminal member of the crossover pair is situated in a second plane different from the first plane to thereby enable cross over the contact/terminal members without contact therebetween. Preferably, the contact/terminal members cross over one another twice such that the relative position of the contact/terminal members at the terminal portion and at the contact portion is the same. In accordance with this embodiment, near-end cross talk between the conductor pair is reduced due to the crossover configuration. In addition, by providing a double crossover of the conductor pair, the modular jack can maintain the standard footprint of an RJ type jack, while providing reduced cross-talk in comparison to standard RJ-type jacks. Preferably, both of the crossovers of the conductor pair occur in the same plane. In accordance with a further embodiment of the invention, the double crossover configuration is incorporated into the bi-level offset multiple port jack described above to provide a compact, multiple port jack which exhibits reduced cross-talk.

In another embodiment of the invention, a metallic shield for enclosing the outer housing part and the inner housing parts is provided. The shield includes a panel having at least one cantilevered spring beam and at least one bifurcated grounding tab connected to each spring beam. The spring beam is substantially planar and each grounding tab includes a pair of fingers extending out of the plane of the spring beam and outward from the outer housing part. The shield may also include a panel including a PCB grounding post. The PCB grounding post includes a leg portion and a foot portion including mount sides terminating in at least one tine. The foot portion is adapted to be inserted into a mounting hole in a printed circuit board to which the jack is mounted such that upon insertion of the foot portion, the mount sides are compressed inwardly and press against sides of the mounting hole.

BRIEF DESCRIPTION OF THE DRAWINGS

A more complete appreciation of the present invention and many of the attendant advantages thereof will be readily understood by reference to the following detailed description when considered in connection with the accompanying drawings in which:

FIG. 3(*b*) is a cross-section through a bi-level offset multi-port jack in accordance with an embodiment of the invention which includes the outer housing of FIGS. 1A–1G, as well as upper and lower inner housing parts in accordance with a second embodiment of the invention;

FIG. 3(*c*) shows a top view of a prior art modular plug;

FIG. 3(*d*) shows a side view of a prior art modular plug;

FIG. 5(*b*) shows an isometric view of a contact arrangement for an upper receptacle in accordance with a first embodiment of the invention;

FIG. 6(*b*) shows a cross-section through the component housing of FIG. 6(*a*);

FIG. 7(*b*) shows a more detailed side view of a grounding post of the shield of FIG. 7(*a*) mounted in a PCB;

FIG. 7(*c*) shows a side view of the shield of FIG. 7(*a*) prior to insertion of the bi-level offset multi-port jack;

FIG. 9 shows a front view of the grounding post of FIG. 7(*b*) in its uncompressed state;

FIG. 10 shows a side view of the grounding post of FIG. 7(*b*) in its uncompressed state;

FIG. 11 shows a bottom view of the grounding post of FIG. 7(*b*) in its uncompressed state;

DETAILED DESCRIPTION OF THE PREFERRED EMBODIMENTS

Figure 1A:
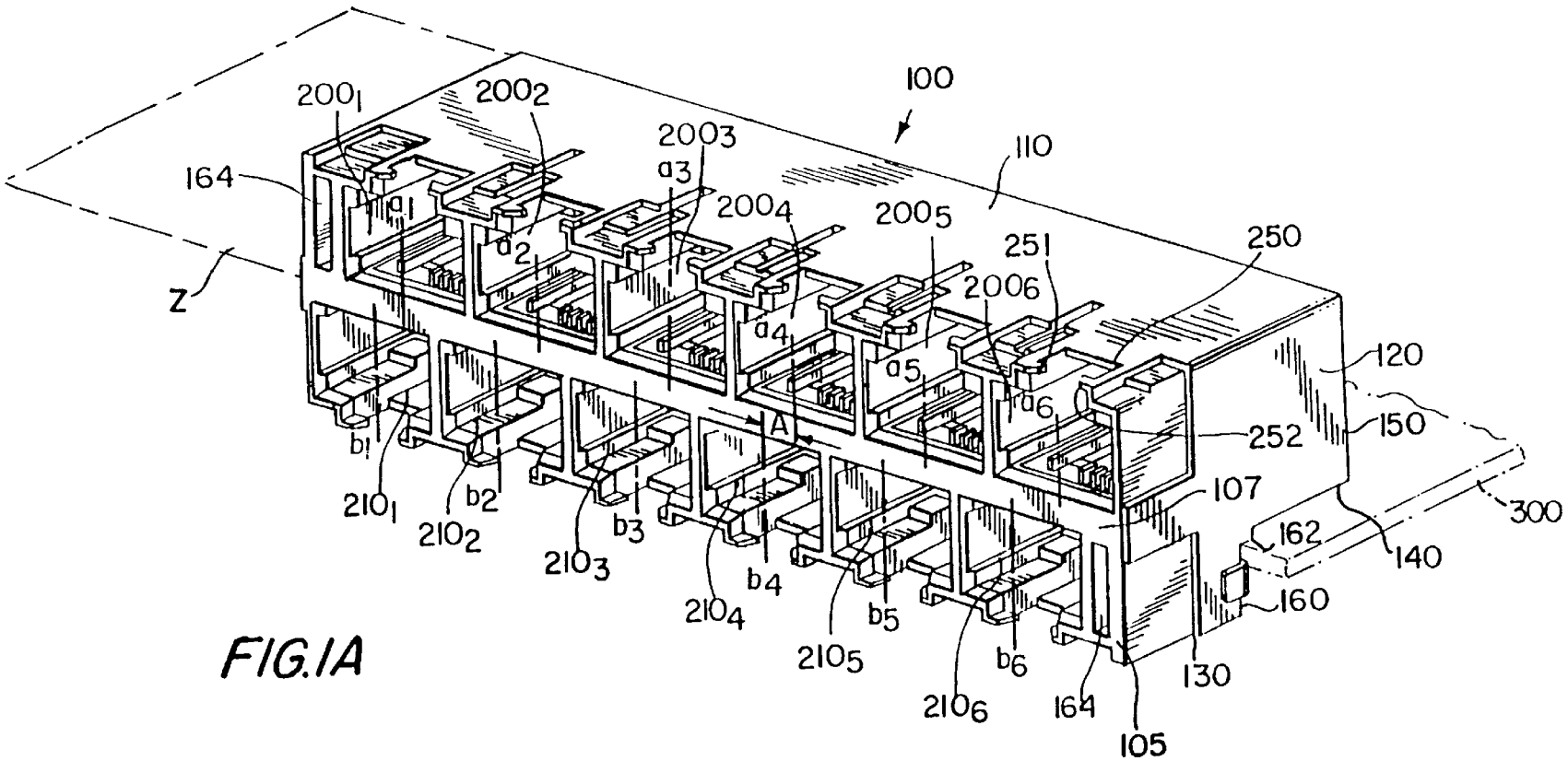
FIG. 1A is a front isometric view of an outer housing part of a bi-level offset multi-port jack in accordance with an embodiment of the invention.

Referring now to the drawings wherein like reference characters designate identical or corresponding parts throughout the several views, a bi-level offset multi-port jack in accordance with the invention is designated generally at 10 and includes an outer housing part 100 (FIGS. 1A–1G), inner housing parts 1000,1010 (FIGS. 2 and 3A) arranged in the outer housing part 100 and an optional shield (FIGS. 7*a*–15).

Figure 1B:
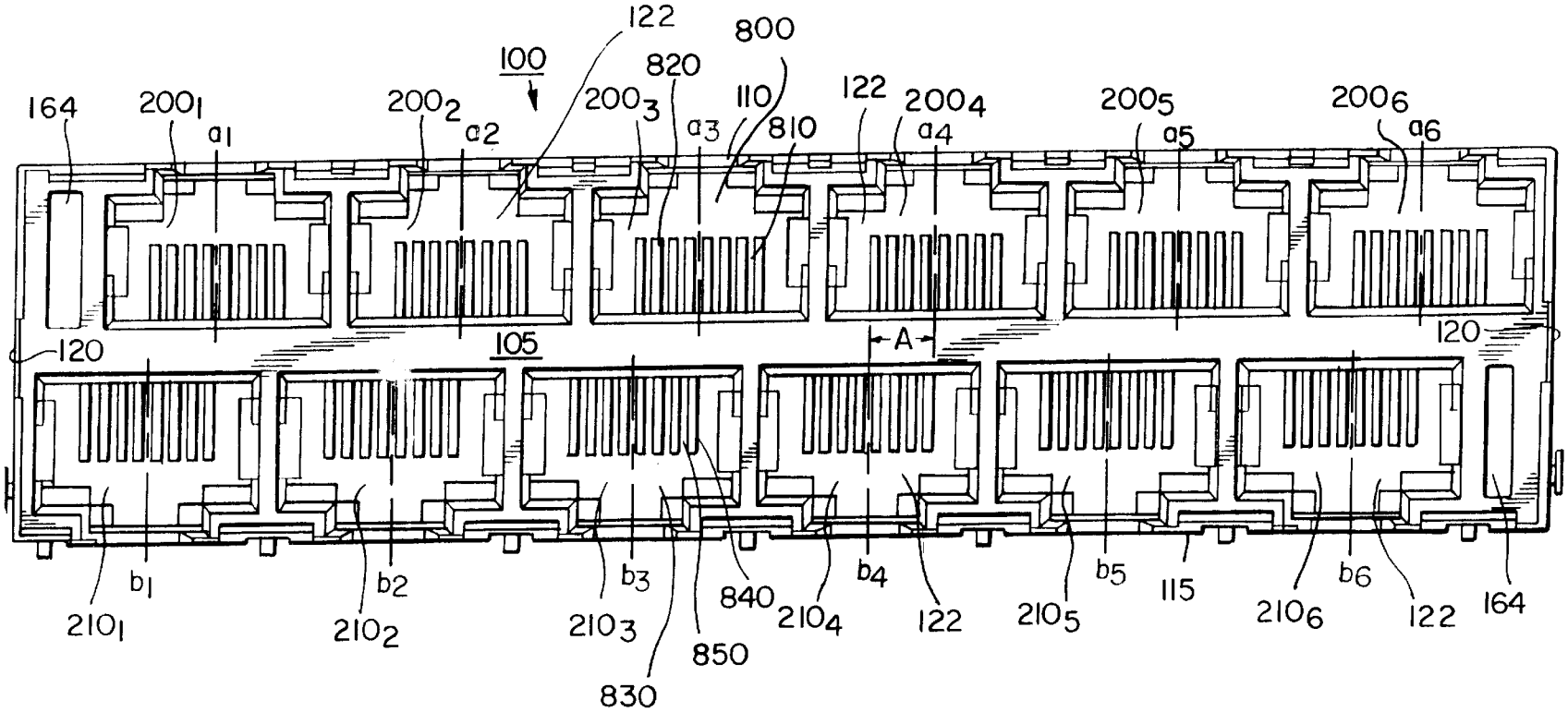
FIG. 1B is a front view of the outer housing part shown in FIG. 1A.

The outer housing part 100 is shown in FIGS. 1A–1G and has a front face 105, a top wall 110, a bottom wall 115 substantially parallel to the top wall 110, opposed lateral walls 120, a forward bottom portion 130, a rearward bottom portion 140, an upper back portion 150 and a lower back portion 160. The front face 105 of the outer housing part 100 has a mid-portion 107 which is substantially parallel to the top and bottom walls 110,115. The front face 105 defines a first, upper row of six plug apertures $\mathbf{200}_i$, each having a vertical plane of symmetry "$a_i$", and a second, lower row of six plug apertures $\mathbf{210}_1$, each having a vertical plane of symmetry "$b_i$", where i=1 through 6. As shown in FIGS. 1A and 1B, the upper plug apertures $\mathbf{200}_1$ through $\mathbf{200}_6$ are offset from the lower plug apertures $\mathbf{210}_1$ through $\mathbf{210}_6$ such that each center axis $a_i$ is offset from its corresponding center axis $b_i$ by a distance A. In other words, a plug aperture 200 in the upper row is not completely, directly opposite any plug aperture 210 in the lower row. Although six plug aperture are formed in each of the upper and lower rows, it is possible to form the jack with any number of plug apertures in each row (not necessarily the same amount in each row), including with a minimum of a single plug aperture in each row.

Rearward bottom portion 140 and lower back portion 160 form a recess which receives a printed circuit board 300 (shown in phantom lines in FIG. 1A), such that the width of the PCB 300 is less than or equal to the length of lower back portion 160. In the embodiment shown in FIG. 1A, a step 162 is also provided to maintain a gap between the rearward bottom portion 140 and the PCB 300 and prevent contact between the rearward bottom portion 140 and the PCB 300.

A pair of vents 164 are provided in the outer housing part 100 to allow air to flow between the face of the jack 10 and the PCB 300, and the components mounted thereon. Each vent 164 extends from an opening in the front face 105 to a rear of the outer housing part 100. The vents 164 do not necessarily have to take the form shown in the illustrated embodiments and moreover, may be utilized in connection with a jack other than the illustrated jack.

Figure 2:
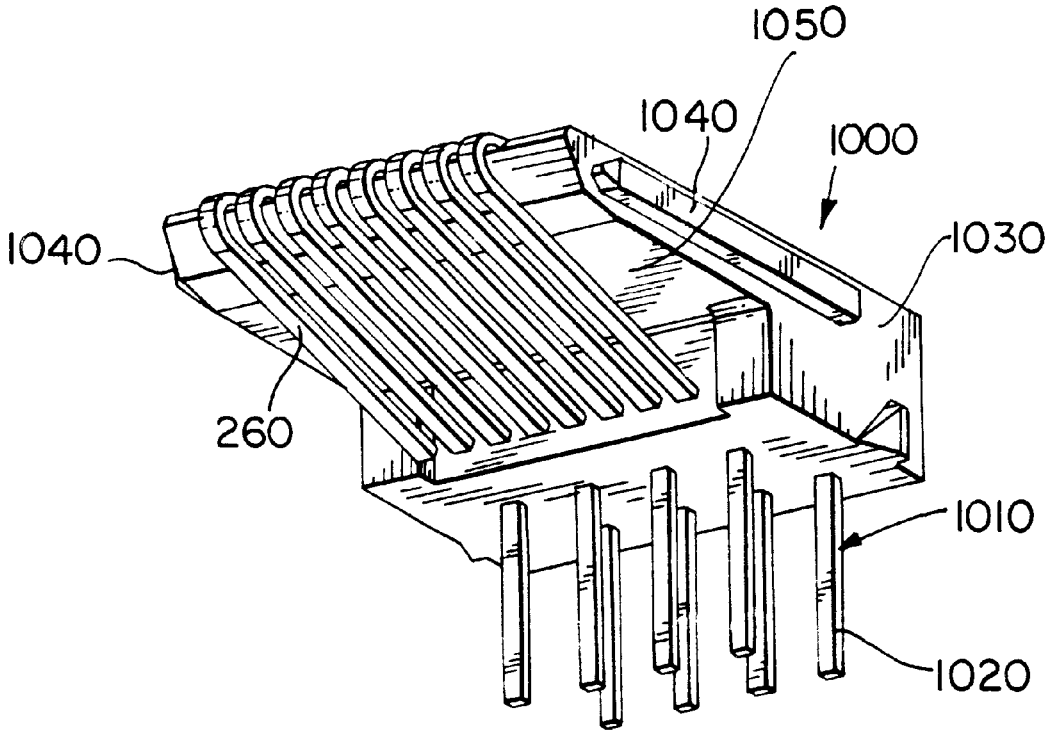
FIG. 2 is an isometric view of a lower inner housing part of a bi-level offset multi-port jack in accordance with an embodiment of the invention.

Referring to FIG. 2, a lower inner housing part (also referred to herein as a lower insert) 1000 includes a generally L-shaped dielectric body 1030 and eight contact/terminal members 1010 which include respective contact portions 260 and respective terminal portions 1020. The L-shaped bodies or contact/terminal member support platforms 1030 have front and rear portions, and each contact/terminal member has between its contact portion and terminal portion an intermediate bridging portion which is attached to said contact/terminal member support platform. Preferably, the contact/terminal members 1010 are mounted within the dielectric body 1030 by injection molding, although other mounting methods known in the art may be utilized. The dielectric body 1030 includes a pair of elongate ribs 1040 on opposing sides of the body 1030. Upon insertion of the lower inserts 1000 into the outer housing part 100, a plug-receiving receivable of a mating plug is formed in alignment with a respective one of the plug apertures 210 in the lower row. Each plug-receiving receptacle is defined by opposed interior walls of the outer housing part 100 (or by one interior wall and the inner surface of a lateral wall 120 of the outer housing part 100), a comb portion 122 of the outer housing part 100, an inner surface of the bottom wall 115 of the outer housing part 100, an upper lip 124 projecting inward from the mid-portion 107 of the front face 105 of the outer housing part 100 and the lower surface 1050 of the front portion of the respective lower insert 1000.

Figure 3A:
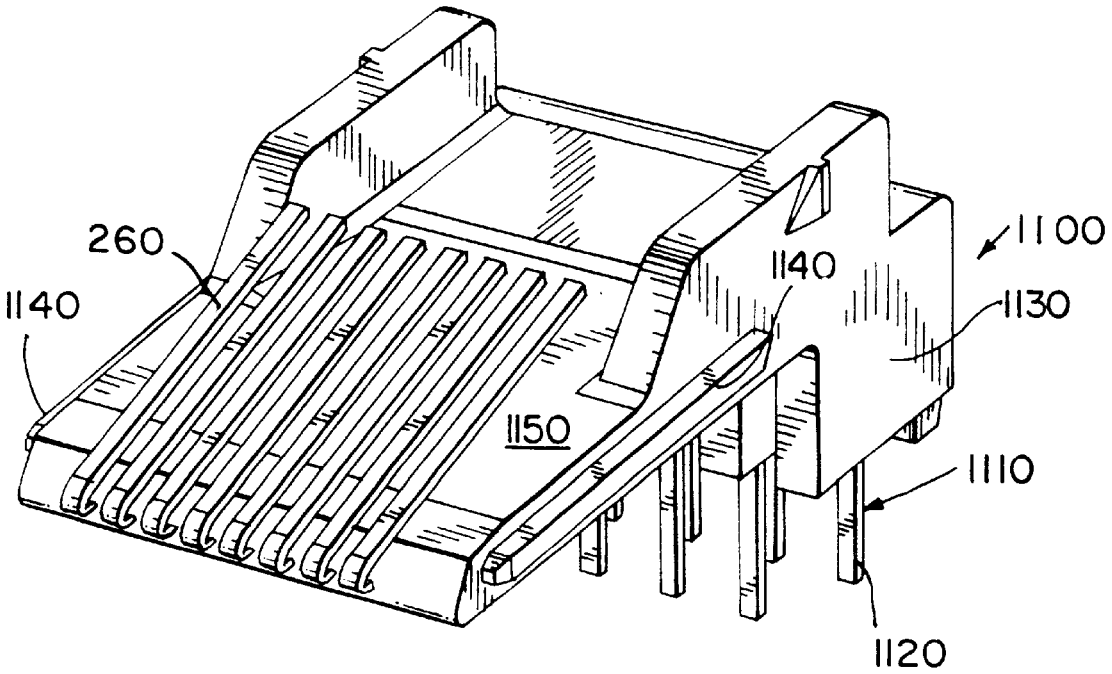
FIG. 3(*a*) shows an isometric view of an upper inner housing part of a bi-level offset multi-port jack in accordance with an embodiment of the invention.

Referring to FIG. 3*a*, an upper inner housing part (also referred to herein as an upper insert) 1100 includes a generally L-shaped dielectric body 1130 and eight contact/terminal members 1110 which include respective contact portions 260 and respective terminal portions 1120. Preferably, the contact/terminal members 1110 are mounted within the dielectric body 1130 by injection molding, although other mounting methods known in the art may be utilized. The dielectric body 1130 includes a pair of elongate ribs 1140 on opposing sides of the body 1130. Upon insertion of the upper inserts 1100 into the outer housing part 100, a plug receiving receptacle receivable of a mating plug is formed in alignment with a respective one of the plug apertures 200 in the upper row of the front face 105 of the outer housing part 100. Each plug receiving receptacle is defined by opposed interior walls of the outer housing part 100 (or by one interior wall and the inner surface of a lateral wall 120 of the outer housing part 100), a comb portion 122 of the outer housing part 100, an inner surface of the top wall 110 of the outer housing part 100, a lower lip 126 projecting inward from the mid-portion 107 of the front face 105 of the outer housing part 100 and the upper surface 1150 of the respective upper insert 1100.

Other constructions of upper and lower inserts may be used in accordance with the invention, e.g., a mixture of forward facing contact/terminal members and rearward facing contact/terminal members.

Figure 1C:
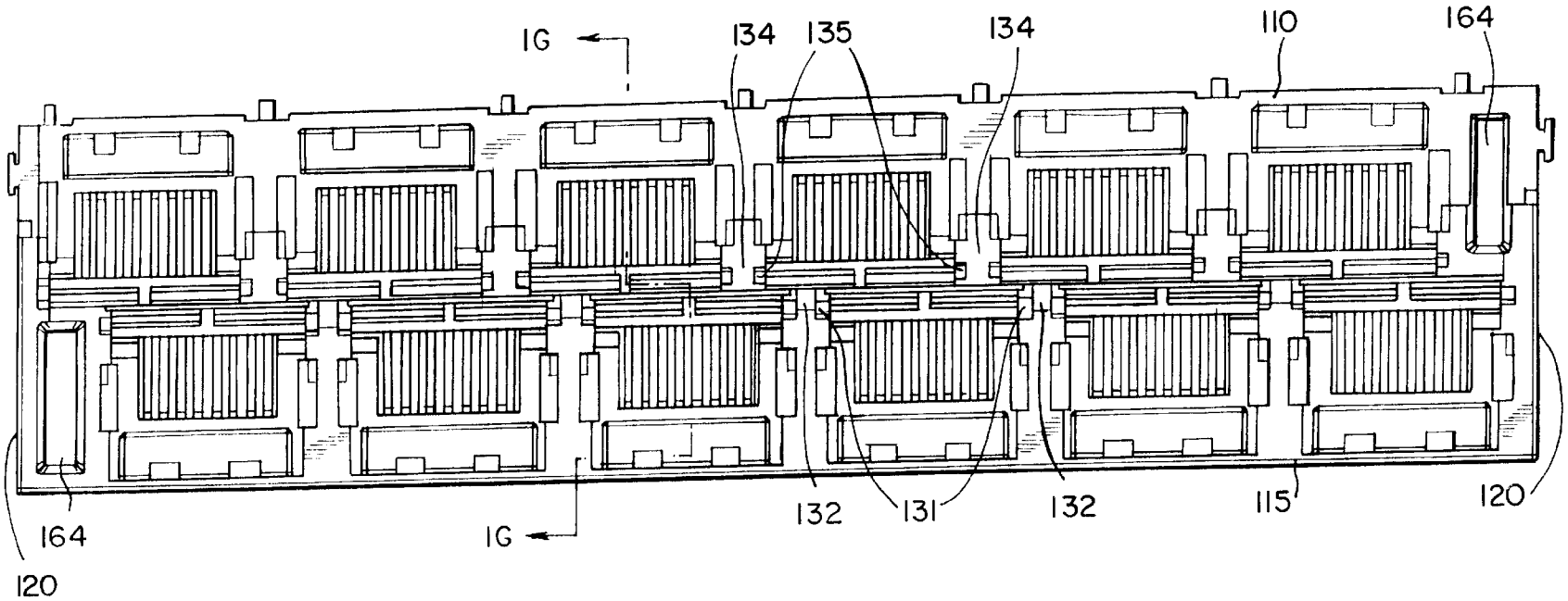
FIG. 1C is a rear view of the outer housing part shown in FIG. 1A.
Figure 4:
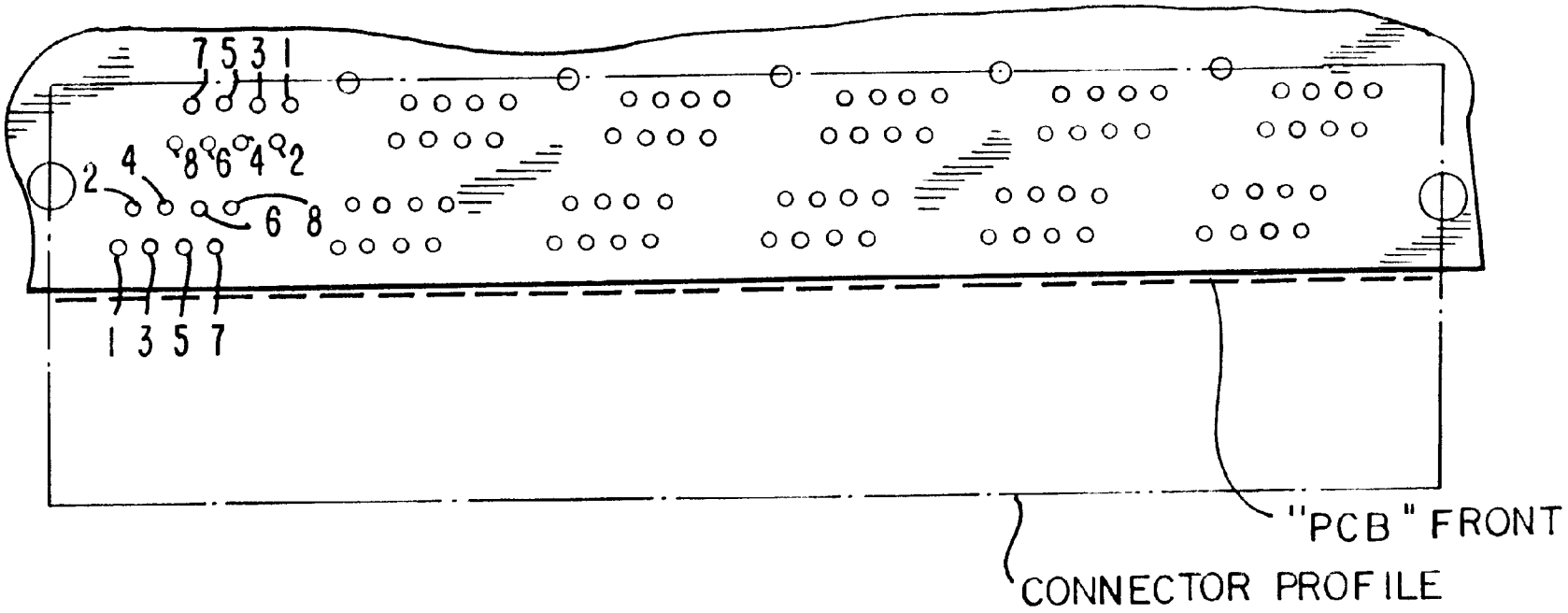
FIG. 4 shows a top view of a PCB for the bi-level offset multi-port jack of FIGS. 1–3(*a*)

To assemble the jack 10, each lower insert 1000 is inserted into the outer housing part 100 by sliding the ribs 1040 thereof into a pair of opposed channels 131 formed between members 132 (FIG. 1C), and each upper insert 1100 is inserted into the outer housing 100 by sliding the ribs 1140 into channels 135 formed between members 134 (FIG. 1C). Once the jack is assembled by inserting the lower and upper inserts 1000 and 1100 into the outer housing part 100, the jack 10 may be mounted to the PCB 300. FIG. 4 shows an illustrative PCB 300 which includes plated through holes which correspond to the positions of the terminal portions 1020, 1120 of the contact/terminal members 1010,1110 of the lower and upper inserts 1000,1100, respectively.

Figure 1D:
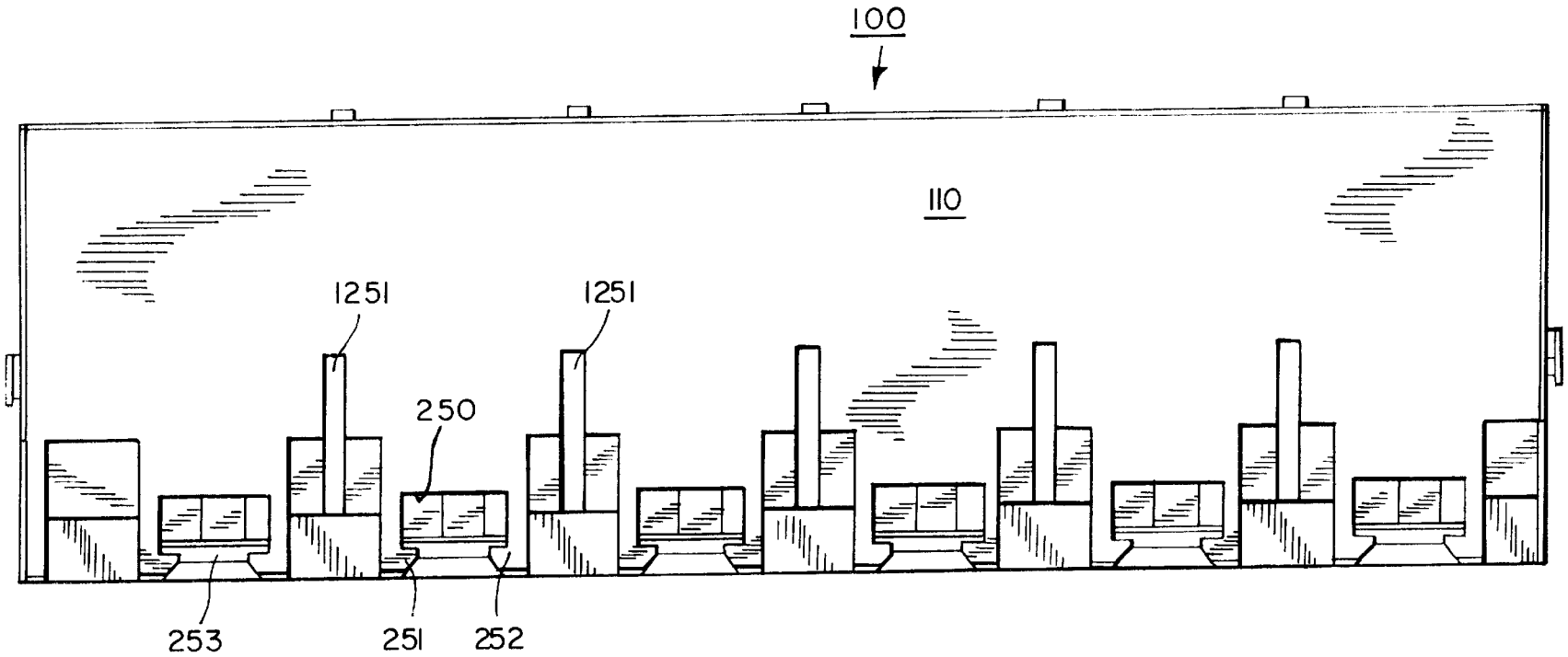
FIG. 1D is a top view of the outer housing part shown in FIG. 1A.
Figure 1E:
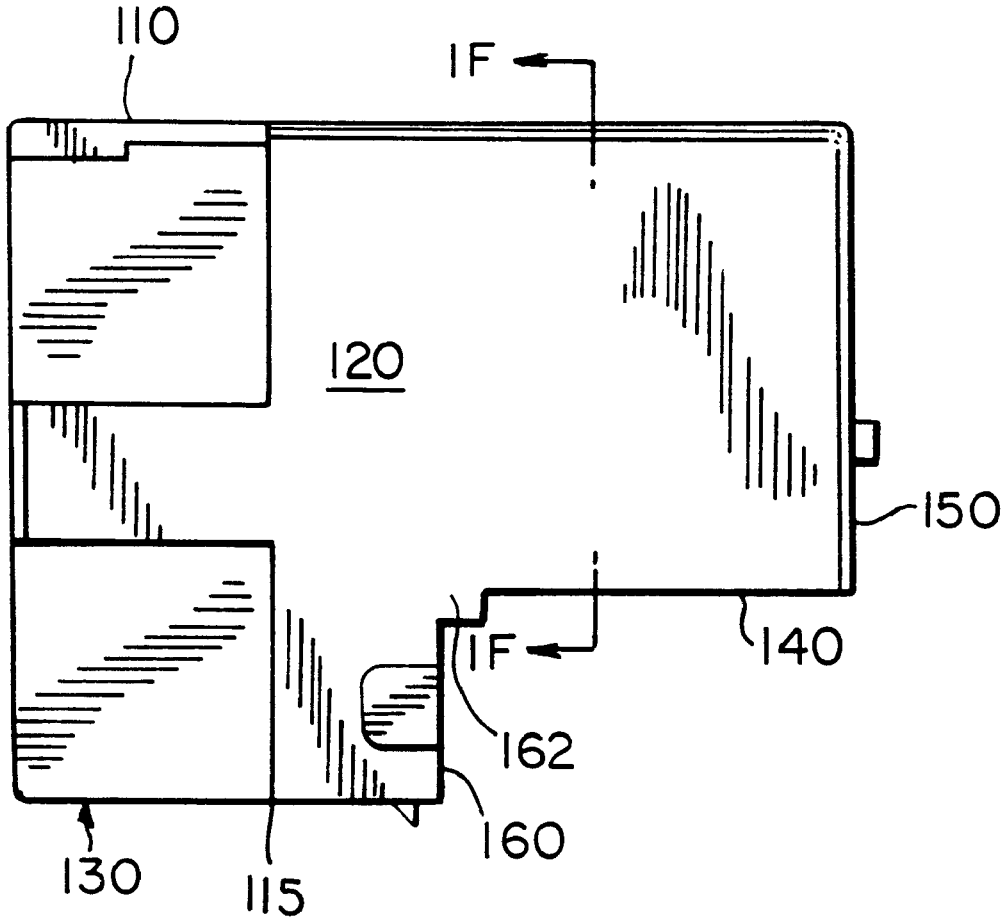
FIG. 1E is a right side view of the outer housing part shown in FIG. 1A.
Figure 1F:
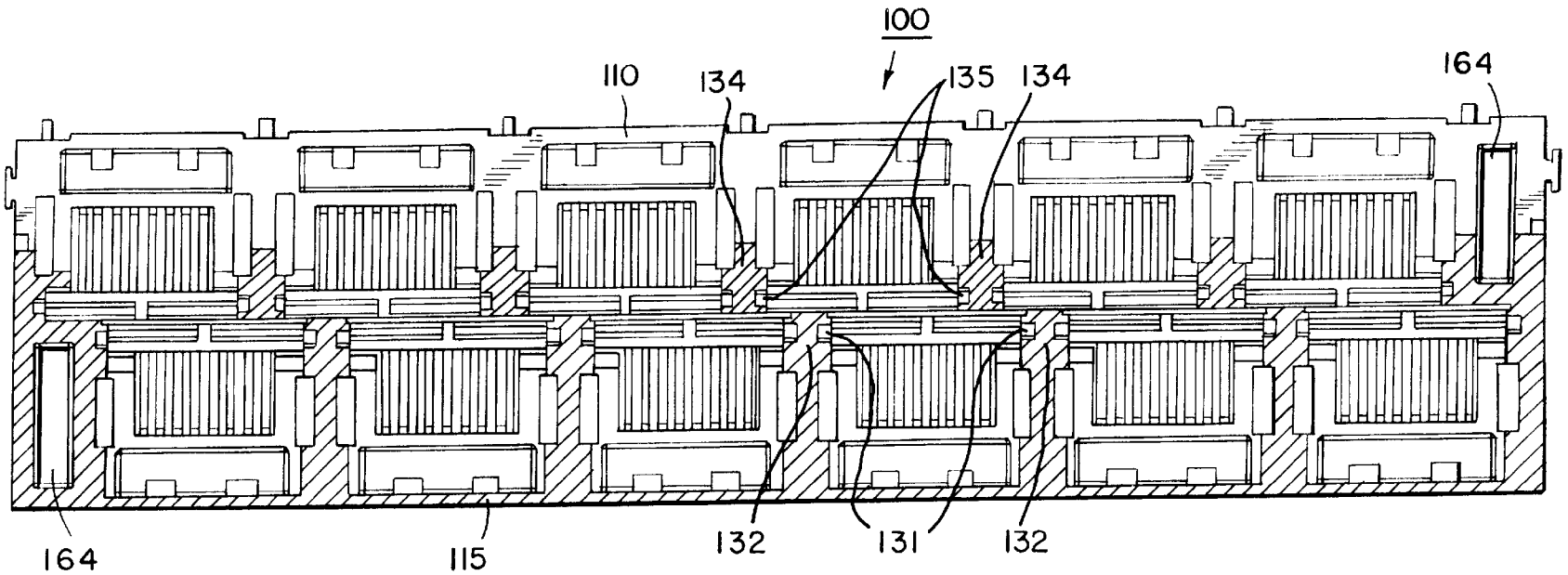
FIG. 1F is view taken along the line 1F—1F of FIG. 1E.

Referring to FIGS. 1A–1G, 2, 3(*a*)–3(*d*), each plug receiving receptacle in the upper and lower row of the jack 10 is configured to receive a respective modular connector plug 220. In this regard, the top wall 110 and bottom wall 115 of the outer housing part 100 includes a latching cutout 250. Each plug 220 includes a plurality of parallel conductor blades 230, and a resilient plug latch 240. When a plug 220 is inserted into one of the receptacles, the conductor blades 230 engage the contact portions 260 of the contact/terminal members 1010,1110, and the resilient plug latch 240 engages the latching cutout 250. In order to reduce the size of the jack 10, each latching cutout 250 comprises an aperture 253 which is partially enclosed by a pair of protrusions 251, 252 (FIG. 1D).

With this construction, when a plurality of bi-level multi-port jacks 10 are mounted vertically above one another on respective PCBs, and plugs 220 are inserted into each receptacle of each jack 10, the plug latch 240 of a plug 220 inserted into an upper receptacle of one jack 10 will not interfere with the plug latch of a plug inserted into a lower receptacle of another jack 10. In addition, since the PCB 300 is mounted within the recess formed by rearward bottom portion 140 and lower back portion 160 (behind the lower row of plug receiving receptacles), the space required for the jack and PCB assembly is reduced as compared to prior art configurations in which the jack is mounted entirely on top of the PCB. In this regard, it is important to note that the provision of a recess in a multi-level jack is independent on the arrangement of plug-receiving receptacles and aligning plug apertures in the front face of the outer housing part of such a jack. In other words, a multi-level jack having a recess at a lower rear for receiving a PCB without offset plug apertures in the front face of the outer housing part is within the scope of the invention.

Figure 6A:
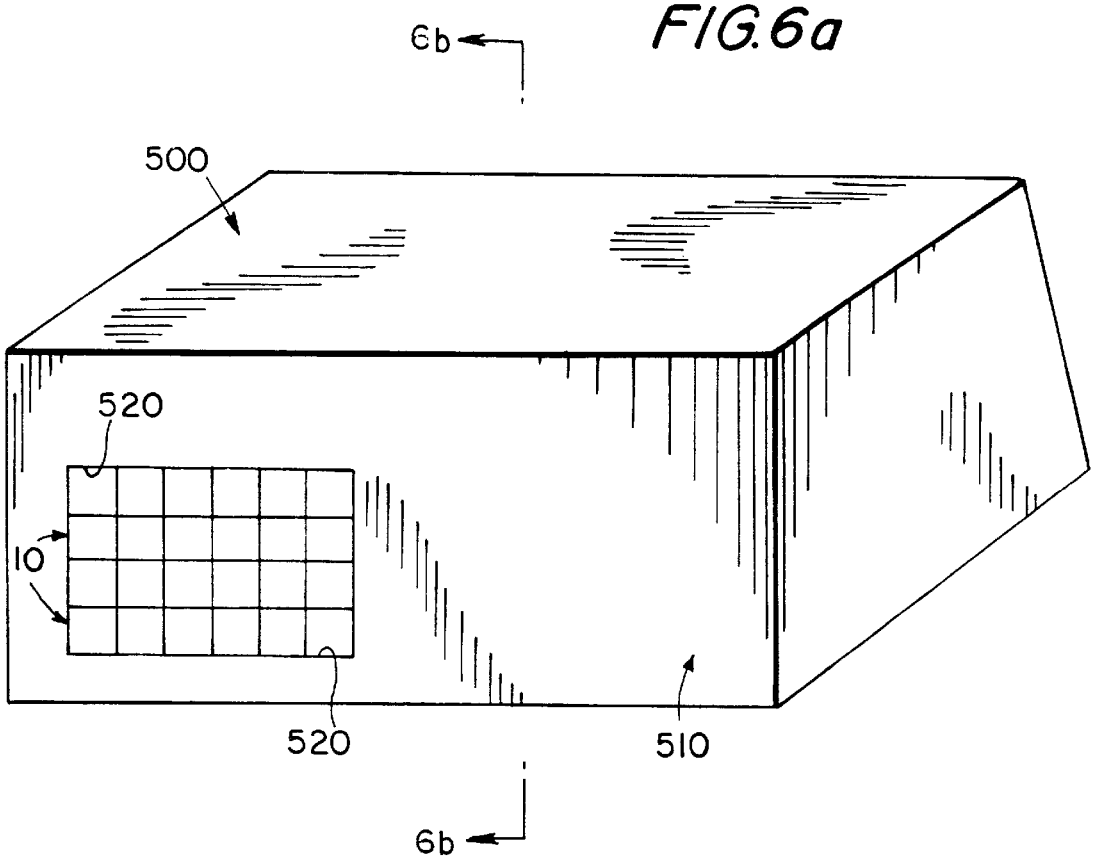
FIG. 6(*a*) shows a pair of bi-level offset multi-port jacks mounted within a component housing.
Figure 6B:
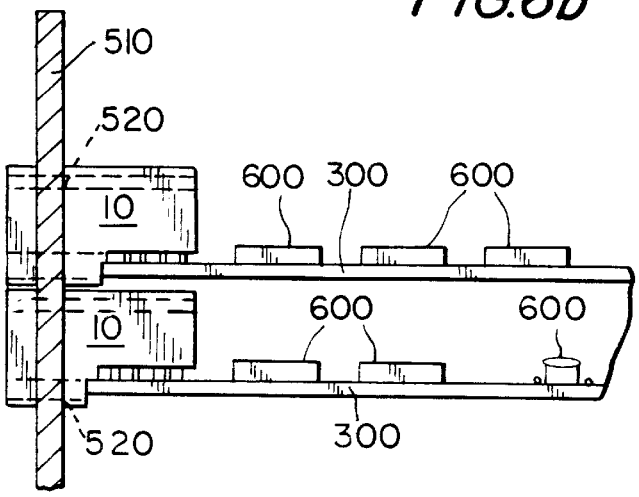

In certain applications, it is contemplated that the front portion of the jack 10 will be disposed within a cut-out of a face plate of a larger housing. Referring to FIGS. 6*a* and 6*b*, an electrical component housing 500 is shown schematically with a pair of bi-level offset multiple port jacks 10 mounted thereon. The component housing 500 includes a face plate 510 with a pair of cutouts 520 formed therein. A pair of jacks 10 extend partially through the face plate 510 and are mounted to respective PCBs 300 having various electrical components 600 mounted thereon. The offset arrangement of the plug apertures 200,210 of each jack 10 allow the cutouts 520 (and thus the jacks 10) to be arranged more closely to one another, thereby saving space. In addition, it would be possible to replace the pair of cutouts 520 with a single cutout, and to stack the jacks directly on top of one another. In addition, referring to FIG. 6*b*, the vents 164 of the jacks 2510, which are indicated by dashed lines, provide ventilation to the PCBs 300 by allowing air to flow into and out of the interior of the component housing 500. In this manner, the electrical components 600 on the PCBs 300 may be cooled by the flow of air through the vents 164.

The provision of vents for allowing air flow through a jack, and in particular, a multi-port jack, is independent of the provision of offset plug apertures n the front face of the outer housing part and may be utilized in a multi-port jack without offset plug apertures.

Figure 3B:
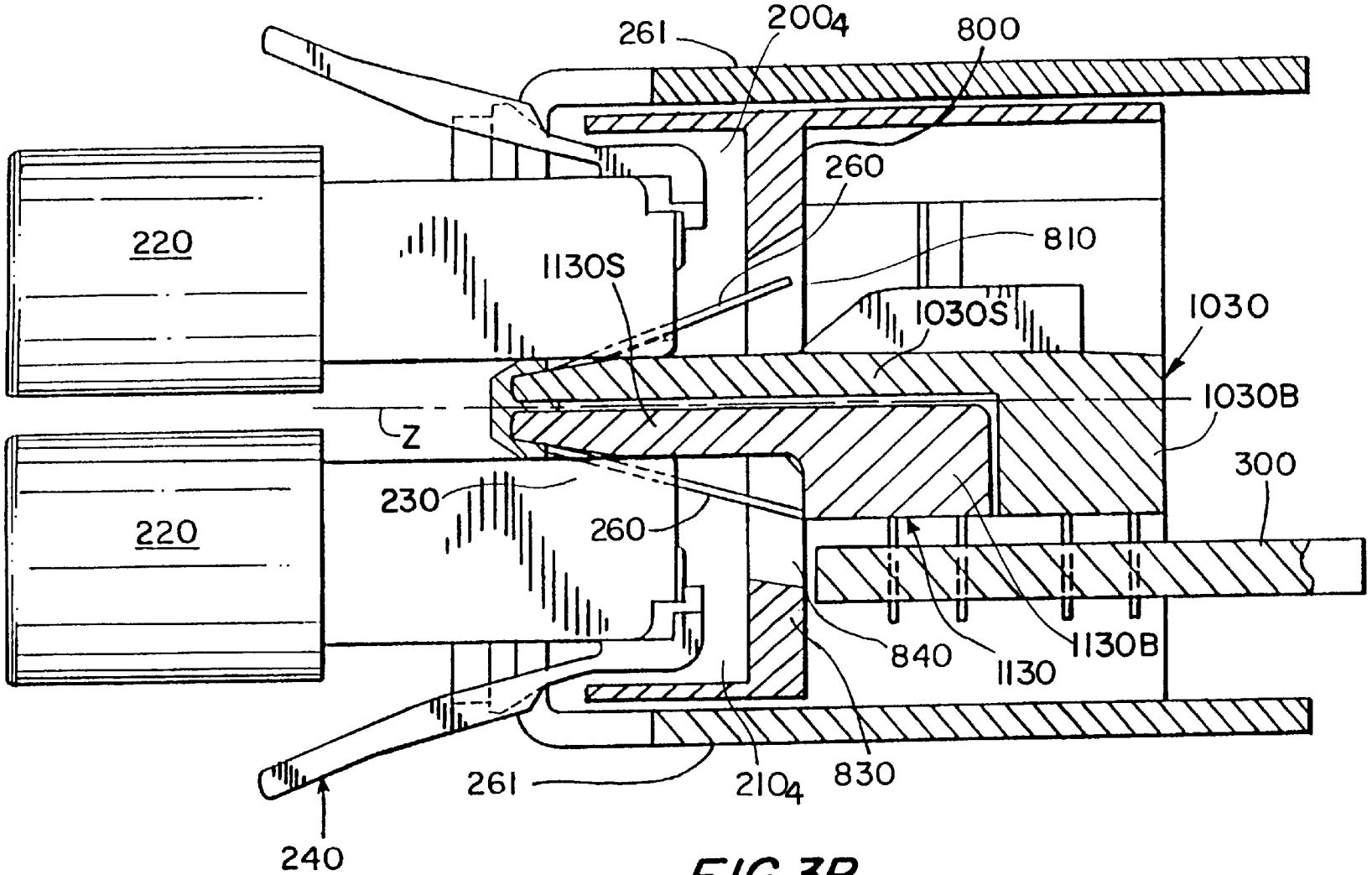

FIG. 3*b* shows another manner in which a jack 10 may be mounted within a face plate of a larger housing. In this application, a generally U-shaped housing 261 has a cutout formed in its closed end, and the jack 10 and at least a portion of the PCB 300 are disposed within the U-shaped housing 261. In this type of application, a plurality of U-shaped housings 261 are generally stacked on top of one another. Therefore, the offset arrangement of the apertures 200, 210 of the jack 10 allow the U-shaped housings to be stacked more closely to one another, thereby saving space. Ventilation of the PCB 300 is accomplished via the vents 164 in the manner described above with regard to FIG. 6*b*. Also seen in FIG. 3B, the L-shaped contact/terminal member support platforms 1030, 1130 are defined by stems 1030S, 1130S and bases 1030B, 1130B of the L-shape. The stems 1030S, 1130S, one above the other, are parallel to each other and to the top wall of the outer housing; the bases 1030B, 1130B are one behind the other. These stems or front portions of these contact/terminal member support platforms are respectively within upper and lower apertures of a set of opposed apertures $\mathbf{200}_4$, $\mathbf{210}_4$, as seen in FIGS. 3B and 1B. Also, these stems or front portions are respectively above and below the central longitudinal plane Z through the mid-portion 107 seen in FIGS. 1A, 1G and 3B.

Figure 1G:
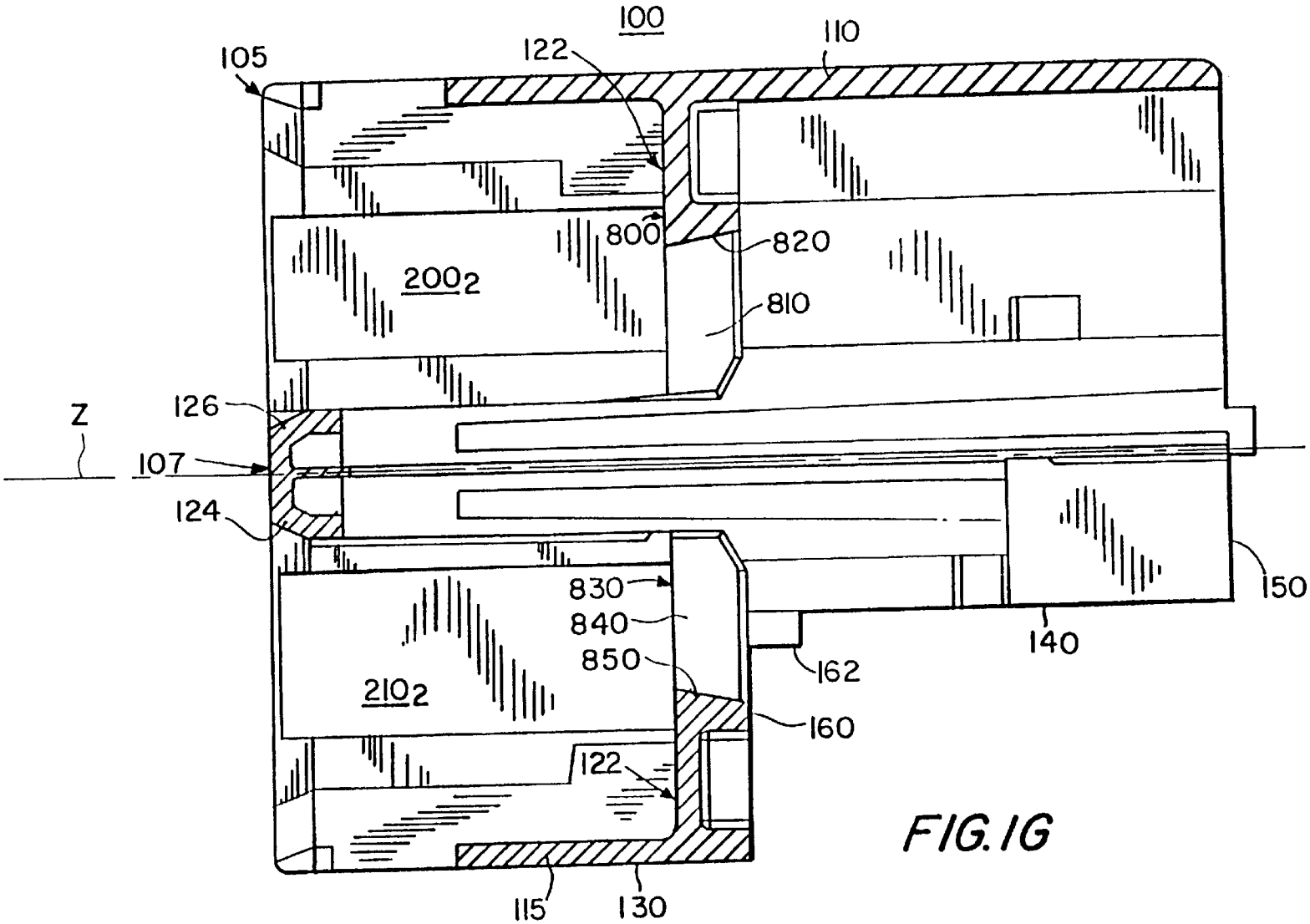
FIG. 1G is a view taken along the line 1G—1G of FIG. 1C.

Referring again to FIGS. 1A–1G, 2 and 3*a* through 3*b*, the manner in which the contact/terminal members 1010,1110 are mounted within the outer housing part 100 will now be described in detail. Each upper plug-receiving receptacle is defined by a comb portion 122 having interior wall 800 having a plurality of longitudinally spaced partitions 810 extending downwardly therefrom which define slots 820 for receiving a contact portion of its respective contact/terminal members 1110 (FIGS. 1B and 1G). Each lower plug-receiving receptacle is defined by a comb portion 122 having interior wall 830 having a plurality of longitudinally spaced partitions 840 extending upwardly therefrom which define slots 850 for receiving a contact portion of its respective contact/terminal members 1010 (FIGS. 1B and 1G).

Figure 5A:
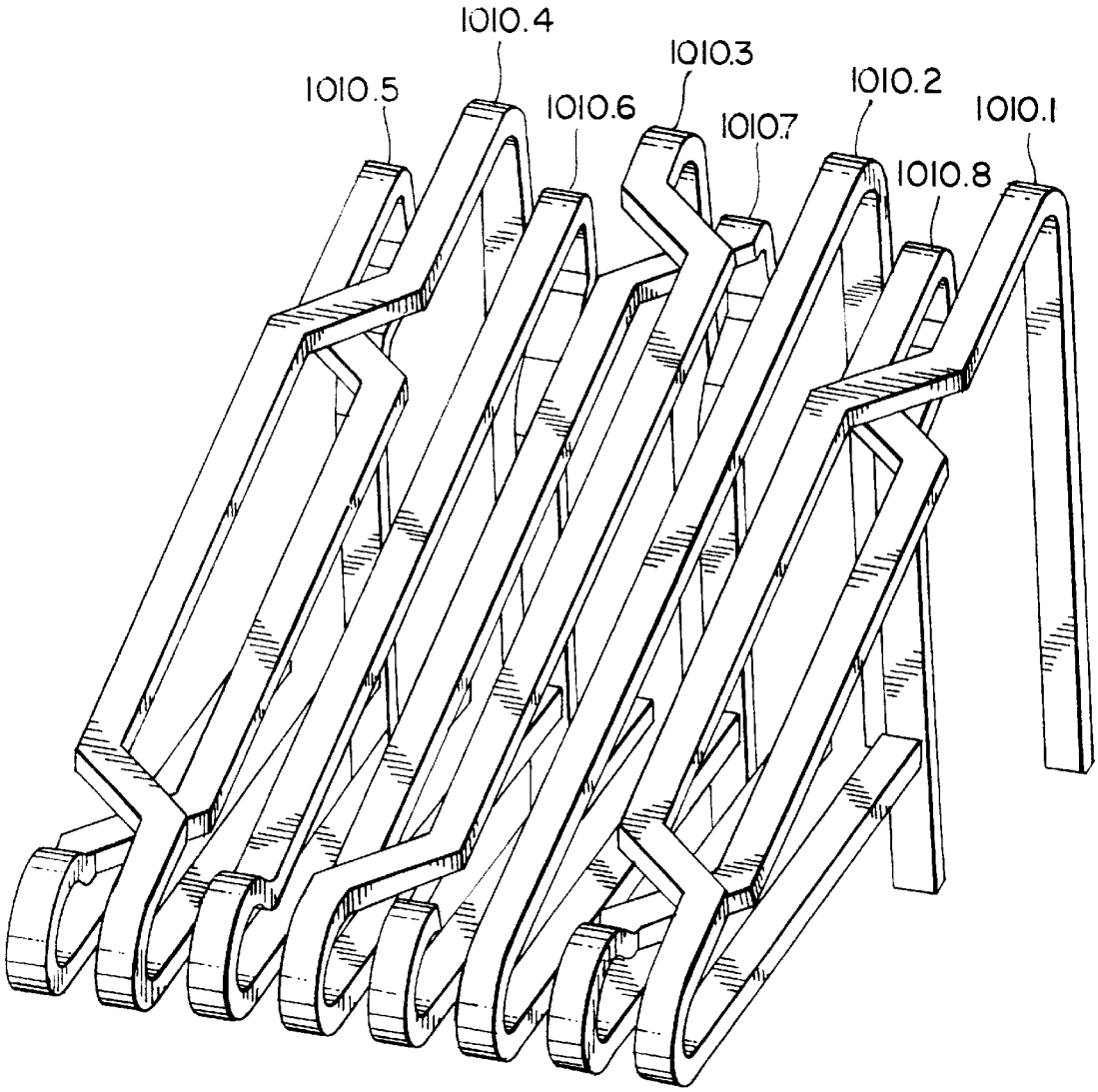
FIG. 5(*a*) shows an isometric view of a contact arrangement for a lower receptacle in accordance with a first embodiment of the invention.
Figure 5B:
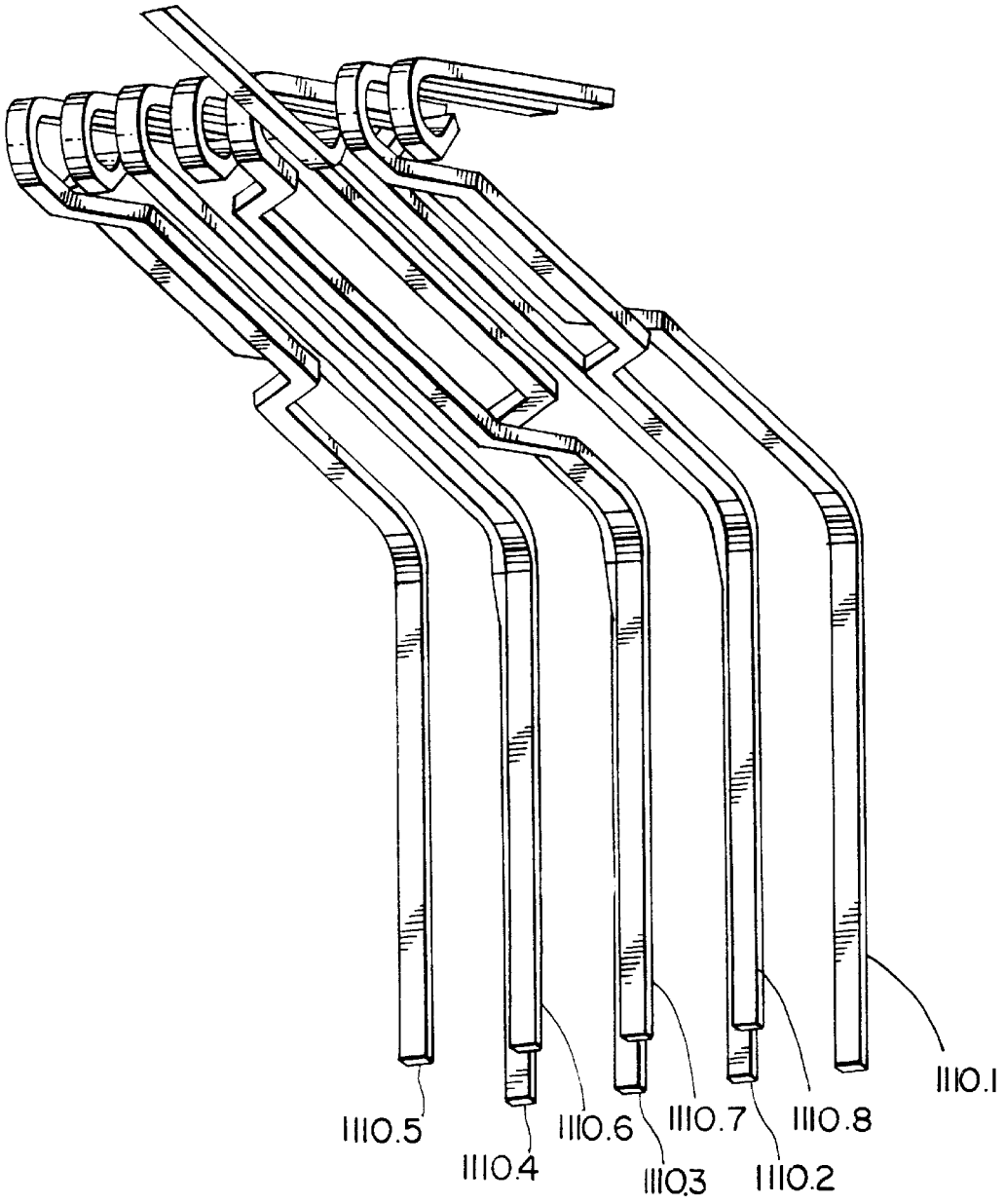

FIG. 5*a* shows an isometric view of the contact/terminal members 1010 of the lower insert 1000 and FIG. 5*b* shows an isometric view of the contact/terminal members 1110 of the upper insert 1100 in accordance with one embodiment of the invention. In accordance with the embodiments shown in FIGS. 5*a* and 5*b*, a double crossover is provided between: contact/terminal members 1010.1 and 1010.8, contact/terminal members 1110.1 and 1110.8, contact/terminal members 1010.3 and 1010.7, contact/terminal members 1110.3 and 1110.7, contact/terminal members 1010.4 and 1010.5, and contact/terminal members 1110.4 and 1110.5. This provides a double crossover of three wire pairs: 1&2, 4&5, and 7&8. It should be noted, however, that a double crossover of 1, 2 or 4 wire pairs may alternatively be provided. Moreover, it should be noted that the double-crossover aspect of the present invention may also be employed in single port modular connectors. The actual crossover of the contact/terminal members occurs in an intermediate bridging portion extending between the contact portion 260 and the terminal portion. More specifically, to provide for the crossover, the intermediate portion of the contact/terminal members which cross over one another are positioned in different planes.

In accordance with the present invention, it has been found that providing a double crossover of one or more wire pairs will result in reduced near-end cross talk in these wires pairs. Preferably, in data communications applications in which 4 wire pairs are used, a double crossover of wire pairs 1&2, 4&5, and 7&8 is provided. In applications in which only wire pairs 1&2 and 3&6 are used, for example Ethernet applications, a double crossover of wire pairs 1&2 and 3&6 is preferably provided. Moreover, it has been found that by providing a double-crossover of wire pairs in accordance with the invention, a modular jack can be provided which meets EIA/TIA Category 5 minimum near-end cross talk isolation standards.

In addition, by providing a double crossover of the wire pairs, the conventional "footprint" of the RJ type connector is maintained. For example, by providing a double crossover, the positions of wires 1–8 of each port of the connector 10 in accordance with the present invention will be identical to the positions of wires 1–8 in a conventional connector which does not include wire crossovers. This is significant because, by maintaining the conventional RJ type footprint, the double crossover modular connector in accordance with the present invention can be used as a drop-in replacement for conventional connectors. In this manner, the present invention allows electrical components to be upgraded to Category 5 requirements without replacing or altering existing PCBs.

As discussed above with regard to FIGS. 6*a* and 6*b*, in certain applications, it is contemplated that the front portion of the jack 10 will be disposed within a cut-out of a face plate of a larger electrical component housing. In such applications, it is desirable to provide a metallic shield which surrounds the jack 10, and which is grounded to the face plate 510 of the housing 500 or 261. Nevertheless, in other applications, a metal shield is also sometimes desirable.

A metallic shield 1200 in accordance with a preferred embodiment of the invention will now be described with respect to FIGS. 7(*a*) through 15. The shield 1200 may be used independent of the jack 10 described above.

Figure 15:
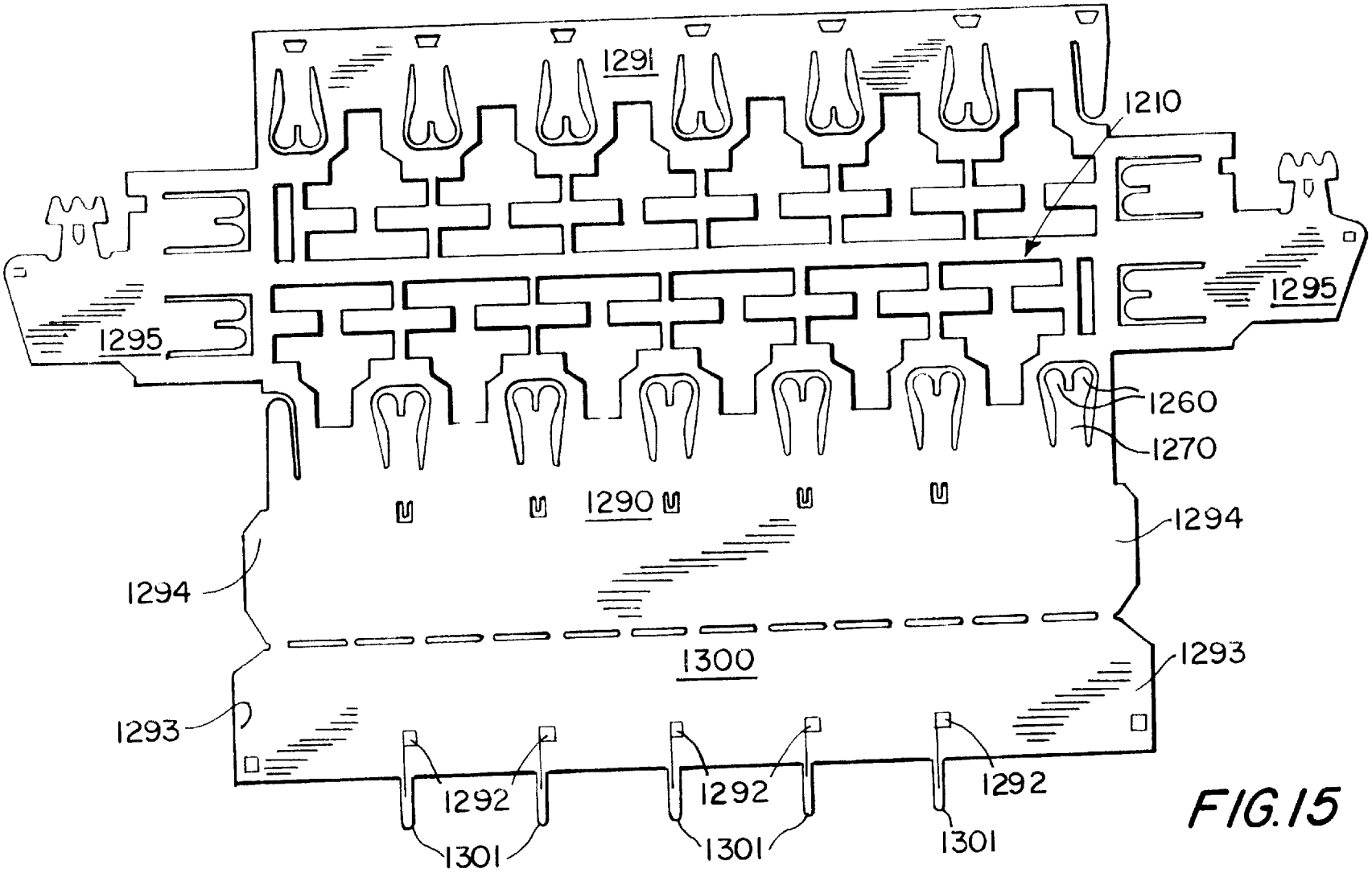
FIG. 15 shows a view of a shield in accordance with the present invention in its flat state.

The metallic shield 1200 is formed, preferably from a single sheet of metal which is flat in its blank state as shown in FIG. 15. Referring to FIGS. 7(*a*) and 15, the shield 1200 is configured to include a face panel 1210, a top panel 1290, a back panel 1300, a bottom panel 1291, and a pair of side panels 1295. The shield 1200 is formed into a free-standing unit by folding the top panel 1290, the bottom panel 1291, and the side panels 1295 about 90 degrees inward relative to the face panel 1210. The top panel 1290 further includes a pair of tabs 1294 which are bent over the respective side panels 1295, and the back panel 1300 similarly includes a pair of tabs 1293 which are bent inwardly about 90 degrees. The resulting free-standing structure is shown in Figure c. Once the jack 10 is inserted into the shield 1200 in the direction indicated in FIG. 7*c*, the back panel 1300 is bent inwardly about 90 degrees, and the tabs 1293 engage the side panels 1295.

Figure 12:
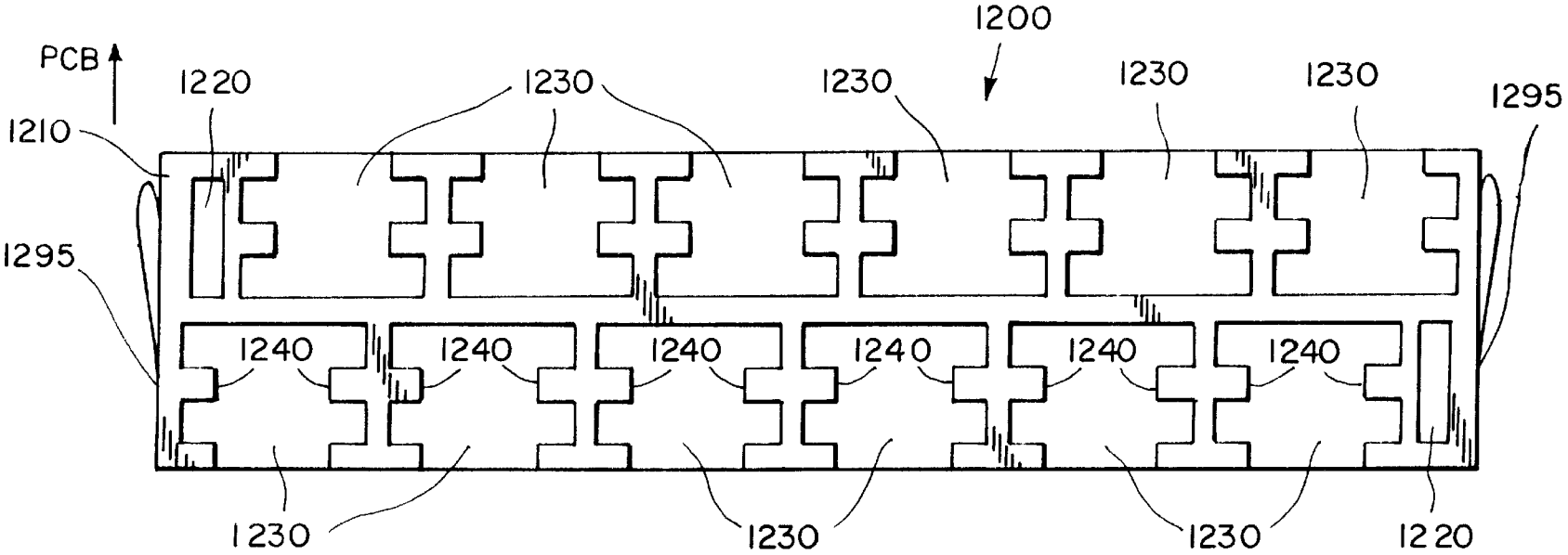
FIG. 12 shows a front view of a shielded bi-level offset multi-port jack in accordance with an embodiment of the invention.

Referring to FIG. 12, the face panel 1210 includes 12 cut-outs 1230 arranged in two substantially parallel rows and which are configured to overlay the upper and lower plug apertures 200, 210 of the jack 10. A pair of opposed tabs 1240 are provided in each cut-out 1230. The tabs 1240 are bent inwardly to reside in respective recesses 1241 in the plug receiving receptacles aligning with the plug apertures 200,210. A pair of cutouts 1220 are also provided in the shield 1200. The cutouts 1220 will overlay the vents 164 of the outer housing part 100 when the shield 1200 is disposed around the jack 10.

Figure 13:
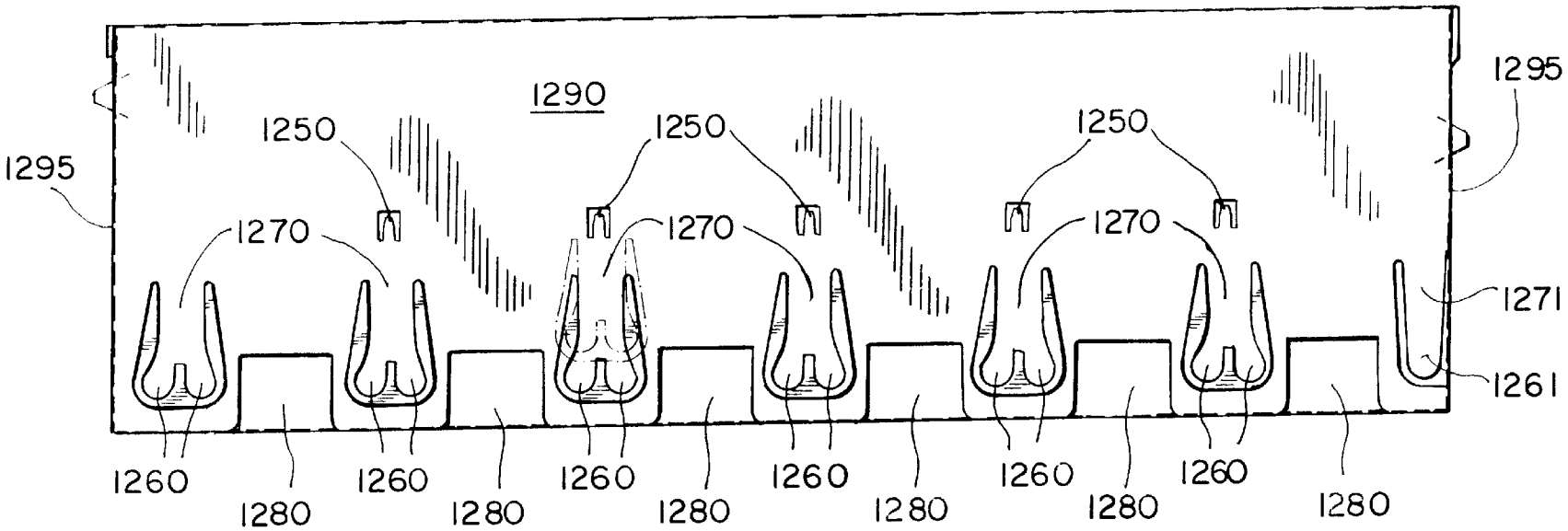
FIG. 13 shows a top view of a shielded bi-level offset multi-port jack in accordance with an embodiment of the invention.

Referring to FIG. 13, the top panel 1290 of the shield 1200 includes five attachment tabs 1250 which are bent downwardly to be secured in respective notches 1251 on the top wall 110 of the outer housing part 100 when the shield 1200 is disposed around the jack 10. Referring to FIGS. 13 and 15, the top panel 1290 further includes bifurcated grounding tabs 1260 and cantilevered spring beams 1270. A trapezoidal grounding tab 1261 and cantilevered spring beam 1271 is also provided. The top panel 1290 also includes six cut-outs 1280 which are configured to overlay respective latching members 250 of the upper receptacles 200 when the shield 1200 is disposed around the jack 10.

Figure 14:
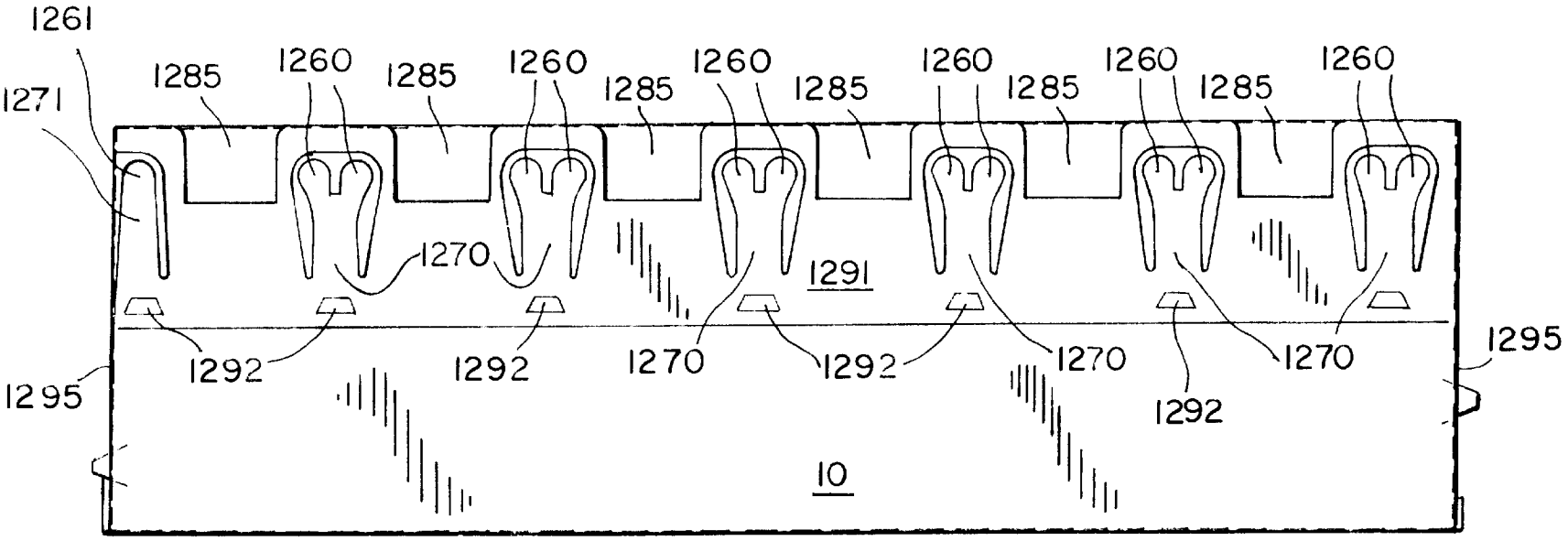
FIG. 14 shows a bottom view of a shielded bi-level offset multi-port jack in accordance with an embodiment of the invention.

Referring to FIG. 14, the bottom panel 1291 is shown disposed around the jack 10. The bottom panel 1291 includes seven staking apertures 1292 which are staked to respective staking posts 1300 on the forward bottom 140 of the exterior housing 100 when the shield 1200 is disposed around the jack 10. The bottom panel 1291 further includes bifurcated grounding tabs 1260 and cantilevered spring beams 1270. A trapezoidal grounding tab 1261 and cantilevered spring beam 1271 are also provided. The bottom panel 1291 also includes six cut-outs 1285 which are configured to overlay respective latching members 250 of the lower receptacles 210 when the shield 1200 is disposed around the jack 10. Referring to FIG. 15, the back panel 1300 includes five metallic posts which are secured to the PCB 300, and six staking apertures 1292 which are secured to respective staking posts (not shown) on the upper back wall 190 of the outer housing 100.

Figure 7A:
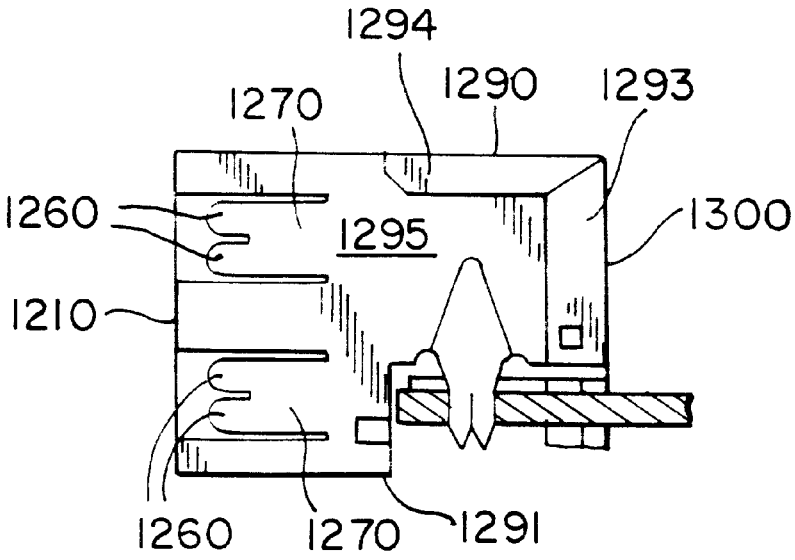
FIG. 7(*a*) shows a side view of the bi-level offset multi-port jack including a shield in accordance with an embodiment of the invention.
Figure 7C:
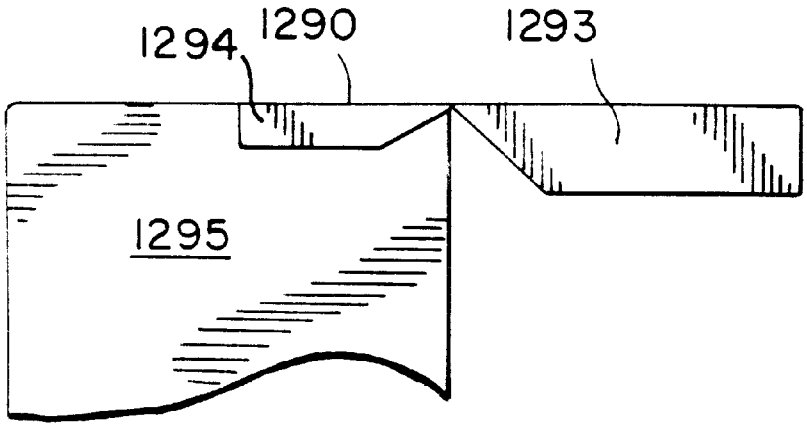
Figure 7B:
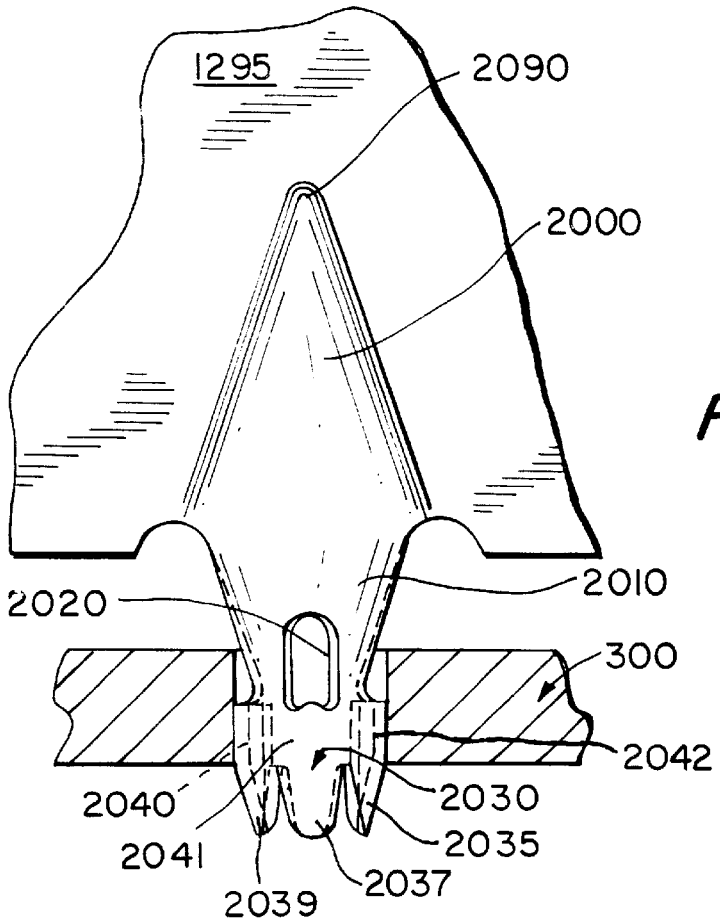
Figure 8:
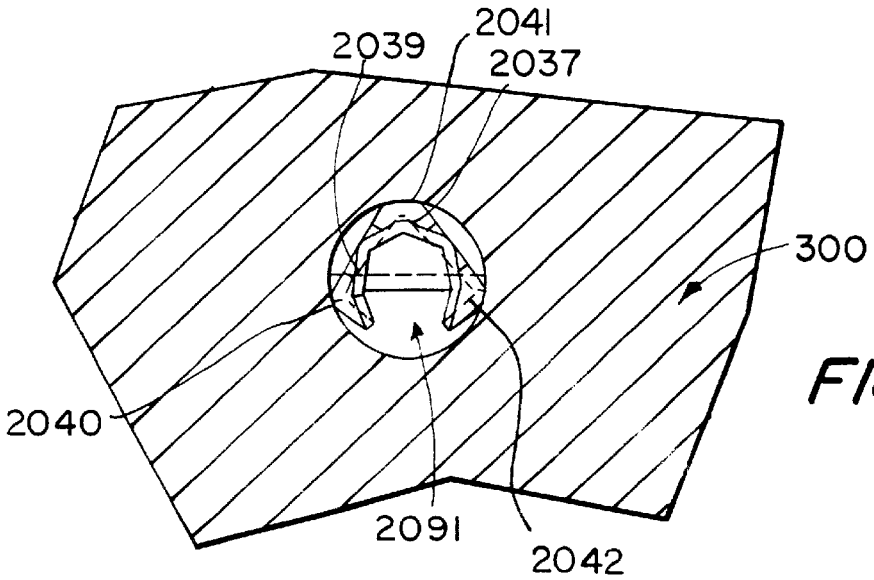
FIG. 8 shows a bottom view of a PCB with the grounding post of FIG. 7(*b*) mounted therein.

Referring to FIG. 7*a*, each of the side panels 1295 similarly includes a pair of bifurcated grounding tabs 1260 and cantilevered spring beams 1270. Each side panel 1295 also includes a PCB grounding post which includes a leg portion 2010 and a foot portion 2030. Referring to FIGS. 7(*b*) through 11, the side panel 1295 preferably includes a gusseted mount portion 2000 to increase the strength of the grounding post. The gusseted mount portion 2000 has a generally concave shape that tapers to a point 2090 at its upper end.

As shown in FIG. 9, the leg portion 2010 and the foot portion 2030 have a generally concave shape. In the embodiment shown in FIGS. 7(*b*) through 11, the foot portion 2030 includes a center mount side 2041 which terminates at one end in a center tine 2037 and terminates at another end a retention edge 2036. The foot portion 2030 also includes a pair of outer mount sides 2040, 2042 which terminate at one end in respective outer tines 2035, 2039 and terminate at another end at respective retention edges 2036. A cutout 2020 is provided in the leg portion 2010 to form the retention edge 2036 on the center mount side 2041. In their uncompressed condition, as shown in FIGS. 10 and 11, the diameter B between the outer surfaces of the mount sides 2040 and 2042 is greater than the diameter of the mounting hole 2091 in the PCB 300. However, the diameter C between the outer tines 2039 and 2035 is less than the diameter of the mounting hole 2091 in the PCB 300. Consequently, as the foot portion 2030 is inserted into the hole 2091 in the PCB, the tines 2035, 2037, 2039 and the mount sides 2040, 2041, 2042 will compress inwardly to provide a press fit between the mount sides 2040, 2041, 2042 and the mounting hole 2091 that insures a reliable mechanical attachment of the jack 10 to the PCB 300 and electrical connection of the shield 1200 to the PCB ground. As shown in FIG. 7(*b*), once the foot portion 2030 is fully inserted into the hole 2091, the mount sides 2040, 2041, 2042 are securely engaged to the wall of the hole 2091.

Figure 3C:
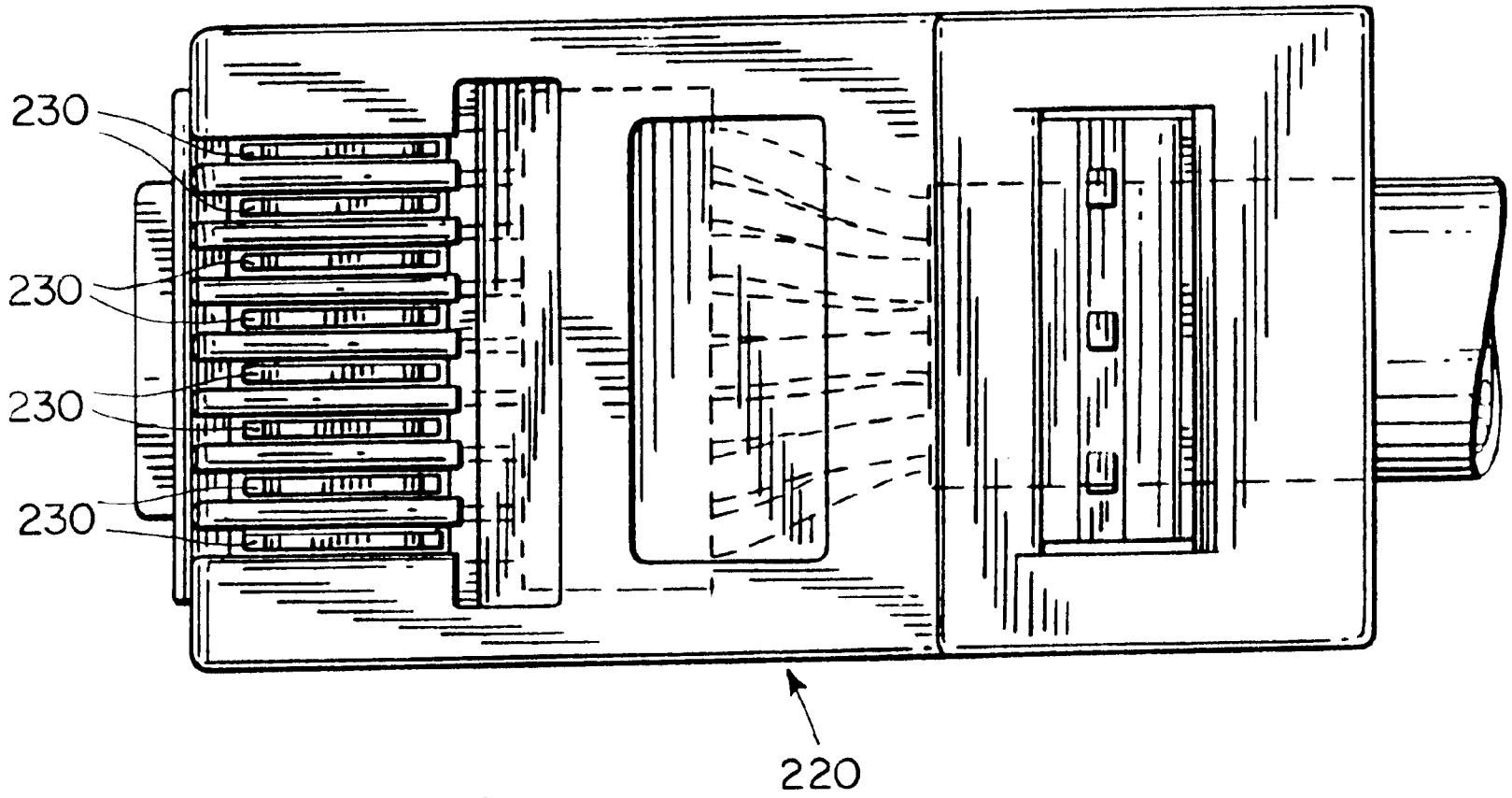
FIG. 3C PRIOR ART
Figure 3D:
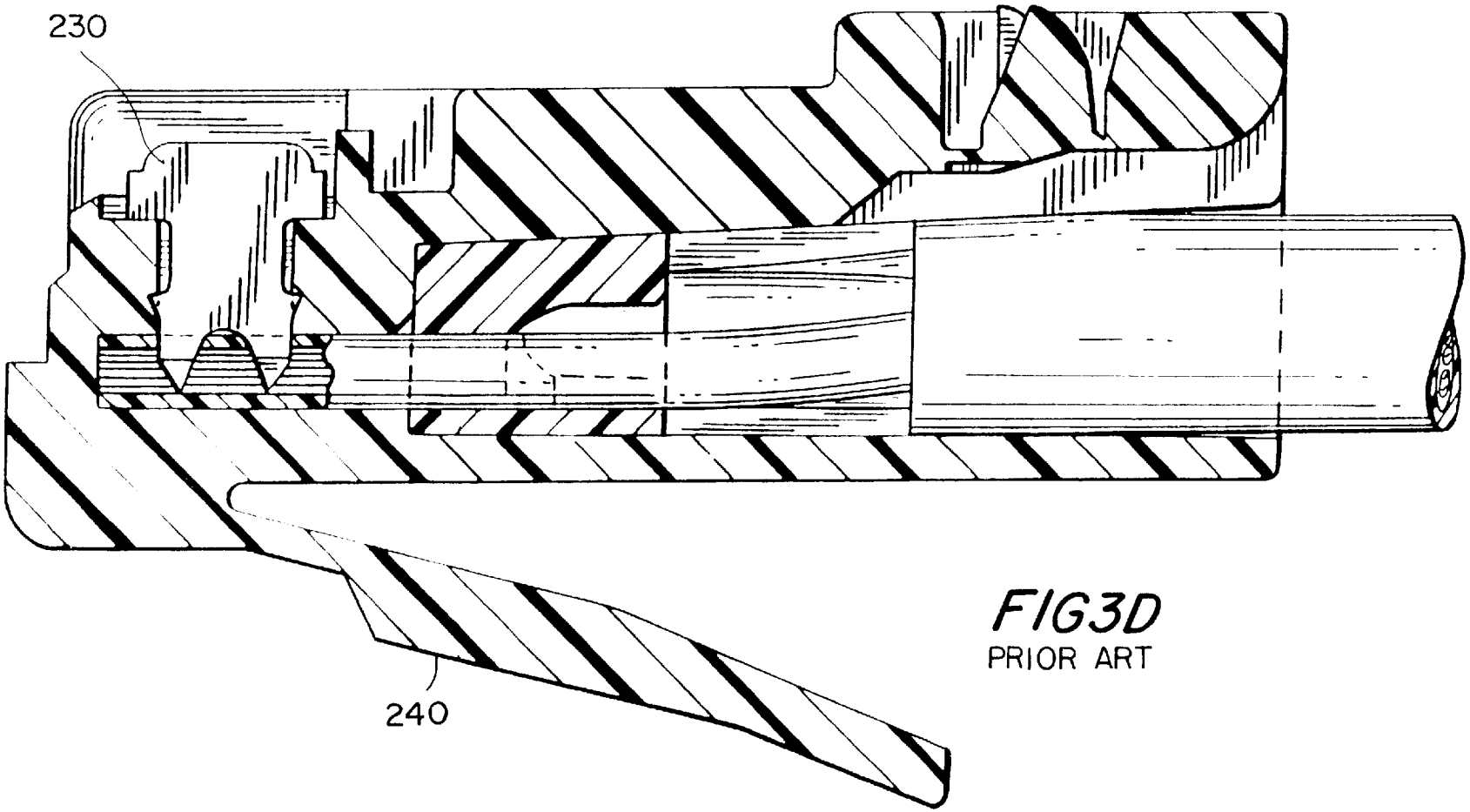
FIG3D PRIOR ART
Figure 16:
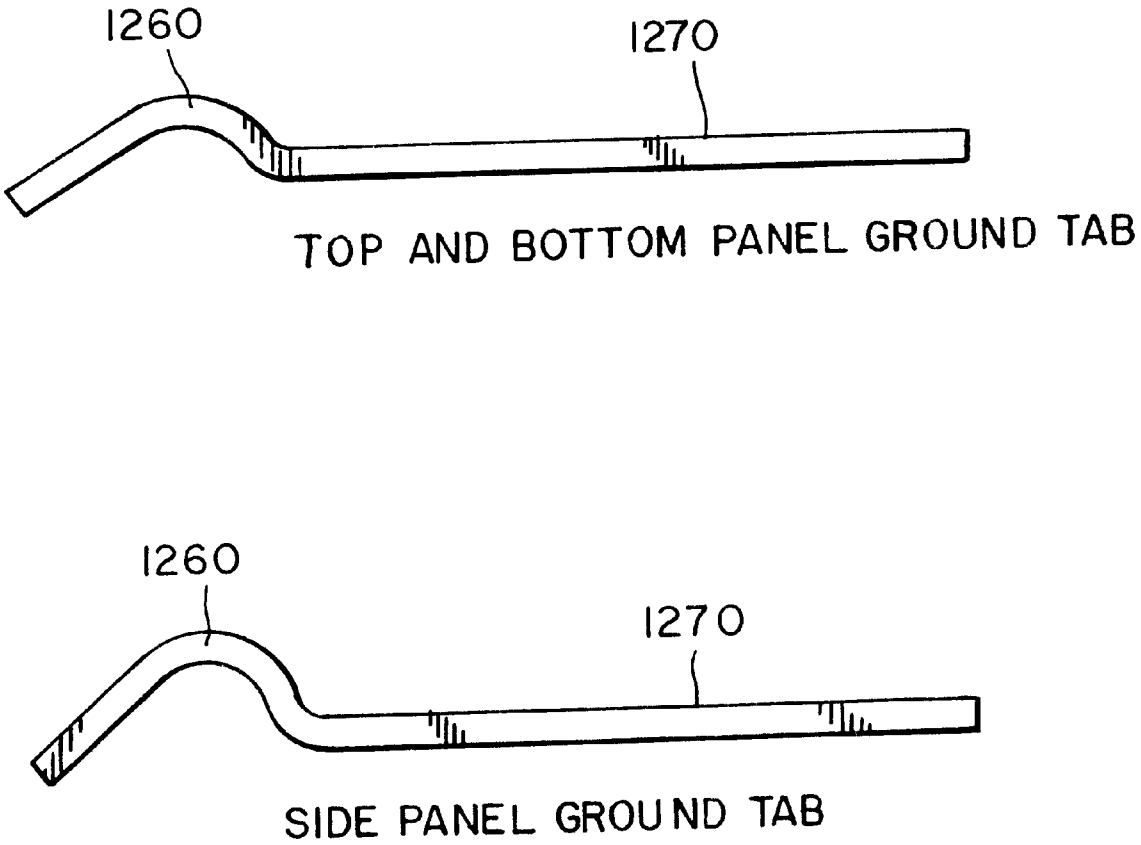
FIG. 16 shows a side view of a bifurcated grounding tab and cantilever beam in accordance with an embodiment of the invention.

When a jack 10 having the shield 1200 mounted thereon is mounted within a cut-out of a face plate of a larger housing (as shown in FIGS. 6*a*, 6*b*, and 3*c*), the bifurcated grounding tabs 1260 establish a ground connection between the shield 1200 and the face plate. In this regard, the cantilevered spring beams 1270 maintain a secure electrical connection between the shield 1200 and the face plate by applying an outward force to the bifurcated grounding tabs 1260. A side view of the bifurcated grounding tabs 1260 and cantilevered spring beams 1270 is shown in FIG. 16.

In addition, in accordance with this embodiment, a single cantilevered spring beam 1270 applies a force to two grounding points (the two fingers of each bifurcated grounding tab 1260), allowing a densely packed arrangement of grounding points. Moreover, since the two fingers of the bifurcated grounding tabs are connected to a central cantilevered spring beam 1270, the fingers can rotate relative to the spring beam 1270 in order to provide contact to the face plate.

In accordance with a further embodiment of the present invention, one or more of the bifurcated grounding tabs 1260 are offset rearwardly with respect to the other grounding tabs 1260 (as indicated with dashed lines in FIG. 13). By providing such a staggered configuration, the tolerances for the distance between the face 1210 of the shield 1200 and the face plate can be increased. In addition, this configuration reduces the installation force which needs to be applied when inserting the jack 10 and shield 1200 through the cutout in the face plate.

In accordance with a further embodiment of the invention, the cutouts 1280 and 1285 exhibit a tapered configuration as shown in FIG. 15. In FIG. 15, the cutouts 1280, 1285 have a first width at their forward end 2086, 2081, and a second, smaller width at their rearward end 2085, 2081. With this configuration, the latch 240 of a plug inserted into the jack is restrained in its movement toward the top (in the case of cutout 1280) or bottom (in the case of cutout 1285) of the jack, while still maintaining a secure engagement with the jack. In this manner, the latch 240 will not interfere, for example, with the removal of an adjacent U-Shaped housing 261 of FIG. 3*c*.

Figure 17:
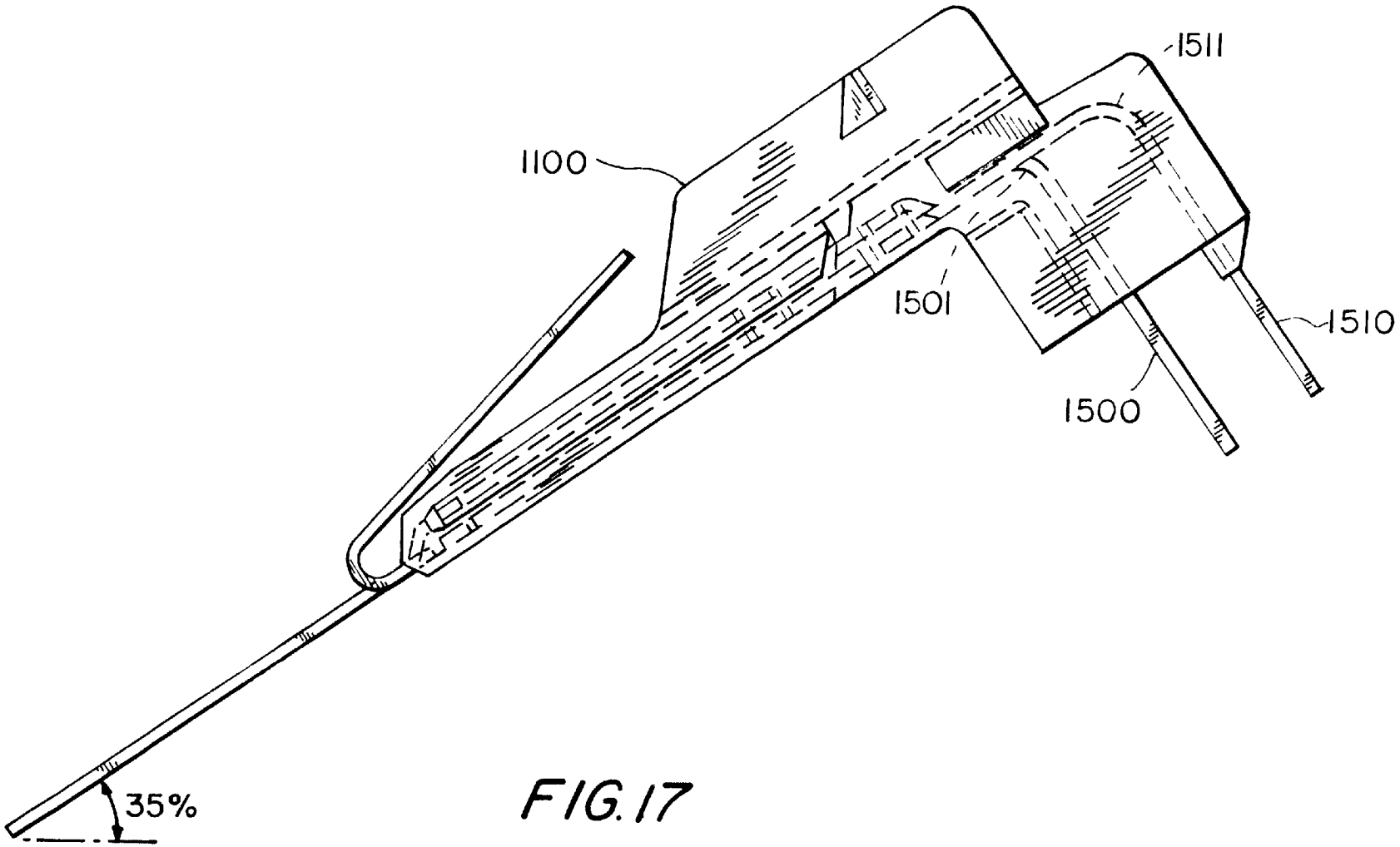
FIG. 17 shows the molding position for the an upper inner housing part of FIG. 3*a*.

In accordance with another aspect of the invention, the upper and lower inserts 1000 and 1100 are manufactured by injection molding. Preferably, the molding position for the upper and lower inserts 1000 and 1100 is 35 degrees or more offset from horizontal as illustrated in FIG. 17. With this manufacturing method, it is possible to manufacture a single piece insert (such as inserts 1000, 1100) using an insert injection molding technique, while employing carrier strips to situate the contact/terminal members in the mold. In accordance with the method according to the invention, the contact/terminal members are formed as a pair of carrier strips, with the interior row of members (e.g. 1010.8, 1010.7, 1010.6, 1010.5) forming one carrier strip and the exterior row of members (e.g. 1010.1, 1010.2, 1010.3, 1010.4) forming the other carrier strip. The members in each carrier strip are maintained in a predetermined spaced apart array because the contact end of each wire terminates in a first common attachment strip, and the terminal end of each wire terminates in a second common attachment strip. The use of such a carrier strip facilitates the injection molding process because individual members need not be handled. It should be noted that the members in the carrier strip may be formed with the double cross-over arrangement described above.

Figure 18:
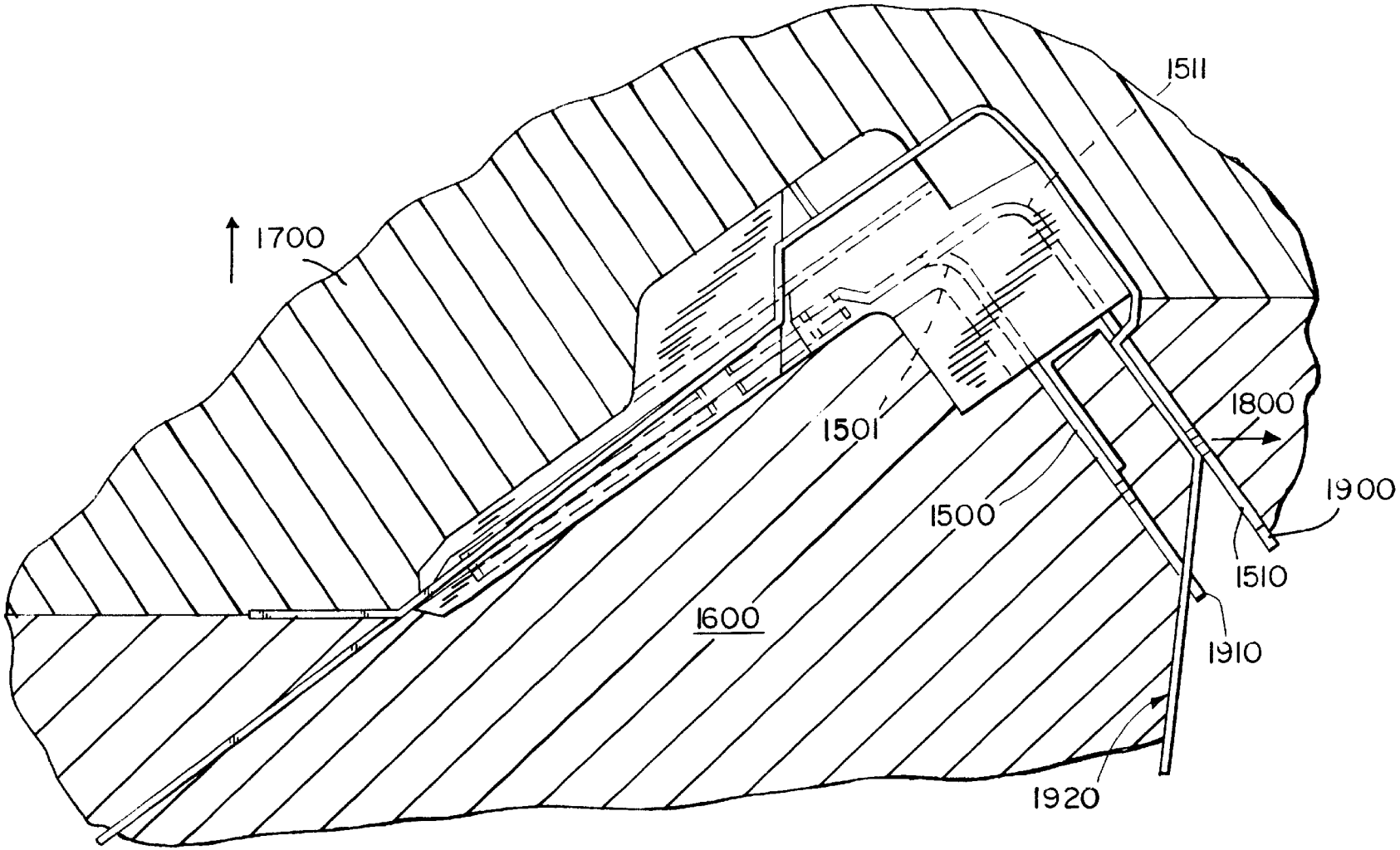
FIG. 18 shows the positioning of the inner housing part relative to a base portion of a mold, a vertically movable upper portion of the mold, and a laterally moving side portion of the mold in accordance with an embodiment of the invention.

In any case, referring to FIG. 17, the carrier strips 1500, 1510 are pre-bent at points 1501 and 1511 prior insertion into the mold. In accordance with the invention, the molding position of the part is set at 35 degrees or more from horizontal as shown in FIGS. 17 and 18 (and preferably at 35 degrees). By providing this molding position, it is possible to mold the insert 1110 in one piece utilizing carrier strips. Referring to FIG. 18, the mold includes a base portion 1600, an upper portion 1700, and a sliding portion 1800. The carrier strips 1500, 1510 are placed in the base portion 1600. During the molding process, the base portion 1600, upper portion 1700, and sliding portion 1800 are in the position indicated in FIG. 18 so that the mold is closed, and dielectric material can flow into the mold to form the part. Once dielectric material has solidified, the upper portion 1700 moves vertically upward and the sliding portion 1800 moves laterally to the right as indicated by the arrows in FIG. 18. It is important to note that in order for the insert 1100 to be removed from the mold, the attachment strips 1900 and 1910 must clear the steel shutoff 1920. Referring to FIG. 18, in order for the attachment strip 1910 to clear the steel shutoff 1920, the assembly must be molded at an angle greater than or equal to 35 degrees from horizontal.

Obviously, numerous modifications and variations of the present invention are possible in light of the above teachings. Accordingly, it is understood that other embodiments of the invention are possible in the light of the above teachings.

We claim:

1. A multi-port modular jack, comprising:

an outer housing part having a top wall, a bottom wall and a front face having a mid-portion arranged substantially parallel to and between said top wall and said bottom wall, said front face defining a first row of at least one aperture between said mid-portion and said top wall and a second row of at least one aperture between said mid-portion and said bottom wall, said at least one aperture in said first row having a plane of symmetry offset in relation to a plane of symmetry of said at least one aperture in said second row such that only a portion of said at least one aperture in said first row is directly opposed to said at least one aperture in said second row, inner housing parts, each arranged in said outer housing part to define a plug-receiving receptacle with said outer housing part in alignment with a respective one of said apertures in said front face of said outer housing part, each of said inner housing parts including contact/terminal members for engaging contacts of a plug insertable into a respective one of said plug-receiving receptacles, each plug-receiving receptacle of said first row having a latching cutout and each plug-receiving receptacle of said second row having a latching cutout offset in relation to said latching cutouts of said receptacles of said first row, wherein said outer housing part further includes a forward bottom portion adjacent said front face, an upper back portion adjacent said top wall, a rearward bottom portion adjacent said upper back portion and a lower back portion extending between said forward and rearward bottom portions to thereby define a recess at a rear of said outer housing part behind said at least one aperture in said first row, said recess being receivable of a printed circuit board, and wherein said outer housing part further comprises a step situated between said rearward bottom portion and said lower back portion, said step defining a surface against which the printed circuit board abuts to thereby prevent the printed circuit board from abutting said rearward bottom portion of said outer housing part.

2. A multi-port modular jack, comprising:

an outer housing part having a top wall, a bottom wall and a front face having a mid-portion arranged substantially parallel to and between said top wall and said bottom wall, said front face defining a first row of at least one aperture between said mid-portion and said top wall and a second row of at least one aperture between said mid-portion and said bottom wall, said at least one aperture in said first row having a plane of symmetry offset in relation to a plane of symmetry of said at least one aperture in said second row such that only a portion of said at least one aperture in said first row is directly opposed to said at least one aperture in said second row, wherein said outer housing part comprises at least one vent passage extending from said front face to a rear of said outer housing part, and inner housing parts, each arranged in said outer housing part to define a plug-receiving receptacle with said outer housing part in alignment with a respective one of said apertures in said front face of said outer housing part, each of said inner housing parts including contact/terminal members for engaging contacts of a plug insertable into a respective one of said plug-receiving receptacles.

3. The jack of claim 2, wherein said at least one vent is situated above or below one of said plug-receiving receptacles.

4. A multi-port modular jack, comprising:

an outer housing part having a top wall, a bottom wall, a front face having a mid-portion arranged substantially parallel to and between said top wall and said bottom wall, said front face defining a first row of at least one aperture between said mid-portion and said top wall and a second row of at least one aperture between said mid-portion and bottom wall, said at least one aperture in said first row having a plane of symmetry offset in relation to a plane of symmetry of said at least one aperture in said second row such that only a portion of said at least one aperture in said first row is directly opposed to said at least one aperture in said second row, inner housing parts, each arranged in each of said apertures of said first and second rows of apertures in said outer housing part to define a plug-receiving receptacle with said outer housing part in alignment with a respective one of said apertures in said front face of said outer housing part, each of said inner housing parts including a contact/terminal member support platform and contact/terminal members mounted on said contact/terminal member support platform for engaging contacts of a plug insertable into a respective one of said plug-receiving receptacles and each plug-receiving receptacle of said first row having a latching cutout and each plug-receiving receptacle of said second row having a latching cutout offset in relation to said latching cutouts of said receptacles of said first row, and wherein said outer housing part further includes:

lateral walls, interior walls situated substantially parallel to said lateral walls, and comb portions extending inward from an inner surface of said top wall and an inner surface of said bottom wall, each of said plug-receiving receptacles being defined in part by said top or bottom wall, one of said comb portions, one of said interior walls and another of said interior walls or one of said lateral walls, and a surface of a respective one of said inner housing parts.

5. The jack of claim 4, wherein each of said plug-receiving receptacles is further defined by a lip directed inward from said front face of said outer housing part.

6. A multi-port modular jack, comprising:

an outer housing part having a top wall, a bottom wall and a front face having a mid-portion arranged substantially parallel to and between said top wall and said bottom wall, said front face defining a first row of at least one aperture between said mid-portion and said top wall and a second row of at least one aperture between said mid-portion and bottom wall, said at least one aperture in said first row having a plane of symmetry offset in relation to a plane of symmetry of said at least one aperture in said second row such that only a portion of said at least one aperture in said first row is directly opposed to said at least one aperture in said second row, and inner housing parts, each arranged in each of said apertures of said first and second rows of apertures in said outer housing part to define a plug-receiving receptacle with said outer housing part in alignment with a respective one of said apertures in said front face of said outer housing part, each of said inner housing parts including a contact/terminal member support platform and contact/terminal members mounted on said contact/terminal member support platform for engaging contacts of a plug insertable into a respective one of said plug-receiving receptacles and each plug-receiving receptacle of said first row having a latching cutout and each plug-receiving receptacle of said second row having a latching cutout offset in relation to said latching cutouts of said receptacles of said first row, and wherein said inner housing parts are constructed such that said contact/terminal members extend into a respective one of said plug-receiving receptacles.

7. A multi-port modular jack, comprising:

an outer housing part having a top wall, a bottom wall and a front face having a mid-portion arranged substantially parallel to and between said top wall and said bottom wall, said front face defining a first row of at least one aperture between said mid-portion and said top wall and a second row of at least one aperture between said mid-portion and bottom wall, said at least one aperture in said first row having a plane of symmetry offset in relation to a plane of symmetry of said at least one aperture in said second row such that only a portion of said at least one aperture in said first row is directly opposed to said at least one aperture in said second row, inner housing parts, each arranged in each of said apertures of said first and second rows of apertures in said outer housing part to define a plug-receiving receptacle with said outer housing part in alignment with a respective one of said apertures in said front face of said outer housing part, each of said inner housing parts including a contact/terminal member support platform and contact/terminal members mounted on said contact/terminal member support platform for engaging contacts of a plug insertable into a respective one of said plug-receiving receptacles and each plug-receiving receptacle of said first row having a latching cutout and each plug-receiving receptacle of said second row having a latching cutout offset in relation to said latching cutouts of said receptacles of said first row, and wherein said inner housing parts include at least one lower inner housing part arranged to define a plug-receiving receptacle with said outer housing part in alignment with a respective one of said at least one aperture in said first row in said front face of said outer housing part and at least one upper inner housing part arranged to define a plug-receiving receptacle with said outer housing part in alignment with a respective one of said at least one aperture in said second row in said front face of said outer housing part, said upper inner housing part being different than said lower inner housing part and said first row of at least one aperture being situated below said second row of at least one aperture.

8. The jack of claim 7, wherein each of said at least one lower inner housing part includes a substantially L-shaped dielectric body, said contact/terminal members being mounted in connection with said body, at least one of said contact/terminal members having a contact portion extending obliquely downward from a front of said body and a terminal portion extending downward from a rear of said body.

9. The jack of claim 7, wherein each of said at least one upper inner housing part includes a substantially L-shaped dielectric body, said contact/terminal members being mounted in connection with said body, at least one of said contact/terminal members having a contact portion extending obliquely upward from a front of said body and a terminal portion extending downward from a rear of said body.

10. A multi-port modular jack, comprising:

an outer housing part having a top wall, a bottom wall and a front face having a mid-portion arranged substantially parallel to and between said top wall and said bottom wall, said front face defining a first row of at least one aperture between said mid-portion and said top wall and a second row of at least one aperture between said mid-portion and said bottom wall, said at least one aperture in said first row having a plane of symmetry offset in relation to a plane of symmetry of said at least one aperture in said second row such that only a portion of said at least one aperture in said first row is directly opposed to said at least one aperture in said second row, inner housing parts, each arranged in said outer housing part to define a plug-receiving receptacle with said outer housing part in alignment with a respective one of said apertures in said front face of said outer housing part, each of said inner housing parts including contact/terminal members for engaging contacts of a plug insertable into a respective one of said plug-receiving receptacles, each plug-receiving receptacle of said first row having a latching cutout and each plug-receiving receptacle of said second row having a latching cutout offset in relation to said latching cutouts of said receptacles of said first row, wherein said outer housing part includes channels for guiding insertion of said inner housing parts into said outer housing part, and wherein said channels are formed in lateral walls of said outer housing part extending from said front face to a rear of said outer housing part.

11. A multi-port modular jack, comprising:

an outer housing part having a top wall, a bottom wall and a front face having a mid-portion arranged substantially parallel to and between said top wall and said bottom wall, said front face defining a first row of at least one aperture between said mid-portion and said top wall and a second row of at least one aperture between said mid-portion and said bottom wall, said at least one aperture in said first row having a plane of symmetry offset in relation to a plane of symmetry of said at least one aperture in said second row such that only a portion of said at least one aperture in said first row is directly opposed to said at least one aperture in said second row, and inner housing parts, each arranged in said outer housing part to define a plug-receiving receptacle with said outer housing part in alignment with a respective one of said apertures in said front face of said outer housing part, each of said inner housing parts including contact/terminal members for engaging contacts of a plug insertable into a respective one of said plug-receiving receptacles, wherein said contact/terminal members in each of said inner housing parts include at least one pair of contact/terminal members operatively forming a wire pair which cross over one another.

12. The jack of claim 11, wherein said contact/terminal members include a contact portion adapted to extend into the respective plug-receiving receptacle, a terminal portion adapted to be connected to a printed circuit board and an intermediate bridging portion extending between said contact portion and said terminal portion, the cross over of said at least one pair of contact/terminal members occurring in said intermediate portion.

13. The jack of claim 12, wherein a portion of said intermediate portion of a first one of each of said at least one pair of contact/terminal members is situated in a first plane in said inner housing part and a portion said intermediate portion of a second one of each of said at least one pair of contact/terminal members is situated in a second plane in said inner housing part different from said first plane to thereby enable cross over said contact/terminal members without contact therebetween.

14. The jack of claim 12, wherein said at least one pair of contact/terminal members cross over one another twice such that the relative position of said contact/terminal members at said terminal portion and at said contact portion is the same.

15. A multi-port modular jack, comprising:

an outer housing part having a top wall, a bottom wall and a front face having a mid-portion arranged substantially parallel to and between said top wall and said bottom wall, said front face defining a first row of at least one aperture between said mid-portion and said top wall and a second row of at least one aperture between said mid-portion and bottom wall, said at least one aperture in said first row having a plane of symmetry offset in relation to a plane of symmetry of said at least one aperture in said second row such that only a portion of said at least one aperture in said first row is directly opposed to said at least one aperture in said second row, inner housing parts, each arranged in each of said apertures of said first and second rows of apertures in said outer housing part to define a plug-receiving receptacle with said outer housing part in alignment with a respective one of said apertures in said front face of said outer housing part, each of said inner housing parts including a contact/terminal member support platform and contact/terminal members mounted on said contact/terminal member support platform for engaging contacts of a plug insertable into a respective one of said plug-receiving receptacles and each plug-receiving receptacle of said first row having a latching cutout and each plug-receiving receptacle of said second row having a latching cutout offset in relation to said latching cutouts of said receptacles of said first row, and a metallic shield for enclosing said outer housing part and said inner housing parts.

16. The jack of claim 15, wherein said shield includes a face panel for overlying said front face of said outer housing part, a top panel for overlying said top wall of said outer housing part, a bottom panel for overlying said bottom wall of said outer housing part, side panels for overlying lateral walls of said outer housing part and a back panel for overlying an open rear of said outer housing part.

17. The jack of claim 15, wherein said top wall of said outer housing part includes at least one notch, said shield including at least one attachment tab adapted to be secured within a respective one of said at least one notch in said top wall of said outer housing part.

18. A multi-port modular jack, comprising:

an outer housing part having a top wall, a bottom wall and a front face having a mid-portion arranged substantially parallel to and between said top wall and said bottom wall, said front face defining a first row of at least one aperture between said mid-portion and said top wall and a second row of at least one aperture between said mid-portion and said bottom wall, said at least one aperture in said first row having a plane of symmetry offset in relation to a plane of symmetry of said at least one aperture in said second row such that only a portion of said at least one aperture in said first row is directly opposed to said at least one aperture in said second row, inner housing parts, each arranged in said outer housing part to define a plug-receiving receptacle with said outer housing part in alignment with a respective one of said apertures in said front face of said outer housing part, each of said inner housing parts including contact/terminal members for engaging contacts of a plug insertable into a respective one of said plug-receiving receptacles, and a metallic shield for enclosing said outer housing part and said inner housing parts, wherein said shield includes a panel having at least one cantilevered spring beam and at least one bifurcated grounding tab connected to each of said at least one spring beam.

19. The jack of claim 18, wherein said panel is arranged to overlie said top wall or said bottom wall of said outer housing part, said top wall or said bottom wall overlaid by said panel including at least one recess arranged in opposed relationship to a respective one of said at least one spring beam and associated at least one grounding tab.

20. The jack of claim 18, wherein said spring beam is substantially planar and each of said at least one grounding tab includes a pair of fingers extending out of the plane of said spring beam and outward from said outer housing part.

21. A multi-port modular jack, comprising:

an outer housing part having a top wall, a bottom wall and a front face having a mid-portion arranged substantially parallel to and between said top wall and said bottom wall, said front face defining a first row of at least one aperture between said mid-portion and said top wall and a second row of at least one aperture between said mid-portion and said bottom wall, said at least one aperture in said first row having a plane of symmetry offset in relation to a plane of symmetry of said at least one aperture in said second row such that only a portion of said at least one aperture in said first row is directly opposed to said at least one aperture in said second row, inner housing parts, each arranged in said outer housing part to define a plug-receiving receptacle with said outer housing part in alignment with a respective one of said apertures in said front face of said outer housing part, each of said inner housing parts including contact/terminal members for engaging contacts of a plug insertable into a respective one of said plug-receiving receptacles, and a metallic shield for enclosing said outer housing part and said inner housing parts, wherein said bottom wall of said outer housing part includes at least one staking post, said shield including at least one staking aperture adapted to engage with a respective one of said at least one staking post.

22. The jack of claim 15, said outer housing part includes lateral walls, said shield including side panels for overlying said lateral walls, each of said side panels including a PCB grounding post.

23. A multi-port modular jack, comprising:

an outer housing part having a top wall, a bottom wall and a front face having a mid-portion arranged substantially parallel to and between said top wall and said bottom wall, said front face defining a first row of at least one aperture between said mid-portion and said top wall and a second row of at least one aperture between said mid-portion and said bottom wall, said at least one aperture in said first row having a plane of symmetry offset in relation to a plane of symmetry of said at least one aperture in said second row such that only a portion of said at least one aperture in said first row is directly opposed to said at least one aperture in said second row, inner housing parts, each arranged in said outer housing part to define a plug-receiving receptacle with said outer housing part in alignment with a respective one of said apertures in said front face of said outer housing part, each of said inner housing parts including contact/terminal members for engaging contacts of a plug insertable into a respective one of said plug-receiving receptacles, a metallic shield for enclosing said outer housing part and said inner housing parts, said outer housing part includes lateral walls, said shield including side panels for overlying said lateral walls, each of said side panels including a PCB grounding post, and wherein said PCB grounding post includes a leg portion and a foot portion including at least one tine, said foot portion being adapted to be inserted into a mounting hole in a printed circuit board to which the jack is mounted such that upon insertion of said foot portion, said tines are compressed inwardly and press against sides of the mounting hole.

24. A modular jack, comprising:

an outer housing part having a top wall, a bottom wall and a front face having a mid-portion arranged substantially parallel to and between said top wall and said bottom wall, said front face defining a first row of at least one aperture between said mid-portion and said top wall and a second row of at least one aperture between said mid-portion and said bottom wall, and inner housing parts, each arranged in said outer housing part to define a plug-receiving receptacle with said outer housing part in alignment with a respective one of said apertures in said front face of said outer housing part, each of said inner housing parts including contact/terminal members for engaging contacts of a plug insertable into a respective one of said plug-receiving receptacles, said outer housing part including at least one dedicated vent passage, fluidly isolated from the receptacles, extending from said front face to a rear of said outer housing part to operatively allow air through the jack.

25. The jack of claim 24, wherein said at least one vent is situated above or below and alongside one of said plug-receiving receptacles.

26. A modular jack, comprising:

an outer housing part having a top wall, a bottom wall and a front face having a mid-portion arranged substantially parallel to and between said top wall and said bottom wall, said front face defining a first row of at least one aperture between said mid-portion and said top wall and a second row of at least one aperture between said mid-portion and said bottom wall, and inner housing parts, each arranged in said outer housing part to define a plug-receiving receptacle with said outer housing part in alignment with a respective one of said apertures in said front face of said outer housing part, each of said inner housing parts including contact/terminal members for engaging contacts of a plug insertable into a respective one of said plug-receiving receptacles, said outer housing part including at least one dedicated vent passage extending from said front face to a rear of said outer housing part to operatively allow air through the jack, and wherein said at least one aperture in said first row has a plane of symmetry offset in relation to a plane of symmetry of said at least one aperture in said second row such that only a portion of said at least one aperture in said first row is directly opposed to said at least one aperture in said second row.

27. A multi-port modular jack, comprising:

an outer housing part having a top wall, a bottom wall and a front face having a mid-portion arranged substantially parallel to and between said top wall and said bottom wall, said front face defining a first row of at least one aperture between said mid-portion and said top wall and a second row of at least one aperture between said mid-portion and bottom wall, said at least one aperture in said first row having a plane of symmetry offset in relation to a plane of symmetry of said at least one aperture in said second row such that only a portion of said at least one aperture in said first row is directly opposed to said at least one aperture in said second row, inner housing parts, each arranged in each of said apertures of said first and second rows of apertures in said outer housing part to define a plug-receiving receptacle with said outer housing part in alignment with a respective one of said apertures in said front face of said outer housing part, each of said inner housing parts including a contact/terminal member support platform and contact/terminal members mounted on said contact/terminal member support platform for engaging contacts of a plug insertable into a respective one of said plug-receiving receptacles and each plug-receiving receptacle of said first row having a latching cutout and each plug-receiving receptacle of said second row having a latching cutout offset in relation to said latching cutouts of said receptacles of said first row, wherein for each of said inner housing parts its contact/terminal member support platform has a front portion and an opposite rear portion, with each of said front portions being situated in one of said apertures of said first and second rows of apertures, and wherein each of said contact/terminal member support platforms is generally L-shaped, with said front portion corresponding to the stem of the L and said rear portion corresponding to the base of the L.

28. A multi-port modular jack according to claim 27 wherein for each aperture in said first row there is an opposed aperture in said second row forming a set, and said inner housing parts for each of said sets are situated such that one L-shaped contact/terminal member support platform is oriented similarly to and within the other L-shaped contact/terminal support member platform with their stems of said L-shapes being generally parallel one above the other, and the bases of said L-shapes situated one behind the other.

29. A multi-port modular jack, comprising:

an outer housing part having a top wall, a bottom wall and a front face having a mid-portion arranged substantially parallel to and between said top wall and said bottom wall, said front face defining a first row of at least one aperture between said mid-portion and said top wall and a second row of at least one aperture between said mid-portion and bottom wall, said at least one aperture in said first row having a plane of symmetry offset in relation to a plane of symmetry of said at least one aperture in said second row such that only a portion of said at least one aperture in said first row is directly opposed to said at least one aperture in said second row, inner housing parts, each arranged in each of said apertures of said first and second rows of apertures in said outer housing part to define a plug-receiving receptacle with said outer housing part in alignment with a respective one of said apertures in said front face of said outer housing part, each of said inner housing parts including a contact/terminal member support platform and contact/terminal members mounted on said contact/terminal member support platform for engaging contacts of a plug insertable into a respective one of said plug-receiving receptacles and each plug-receiving receptacle of said first row having a latching cutout and each plug-receiving receptacle of said second row having a latching cutout offset in relation to said latching cutouts of said receptacles of said first row, wherein for each of said inner housing parts its contact/terminal member support platform has a front portion and an opposite rear portion, with each of said front portions being situated in one of said apertures of said first and second rows of apertures, and wherein said mid-portion of said outer housing has a central longitudinal axis, and each of said contact/terminal member support platforms has its front portion situated only above or below said central longitudinal plane.

* * * * *

UNITED STATES PATENT AND TRADEMARK OFFICE

CERTIFICATE OF CORRECTION

PATENT NO. : 6,419,526 B1
APPLICATION NO. : 09/169627
DATED : June 16, 2002
INVENTOR(S) : Fair et al.

It is certified that error appears in the above-identified patent and that said Letters Patent is hereby corrected as shown below:

On the title page please delete *item (60)* and insert *item (60)* Provisional application No. 60/061,469, filed on Oct. 9, 1997

Signed and Sealed this

Seventeenth Day of March, 2009

JOHN DOLL
*Acting Director of the United States Patent and Trademark Office*

UNITED STATES PATENT AND TRADEMARK OFFICE

CERTIFICATE OF CORRECTION

PATENT NO. : 6,419,526 B1
APPLICATION NO. : 09/169627
DATED : July 16, 2002
INVENTOR(S) : Fair et al.

It is certified that error appears in the above-identified patent and that said Letters Patent is hereby corrected as shown below:

On the title page please delete *item (60)* and insert *item (60)* Provisional application No. 60/061,469, filed on Oct. 9, 1997

This certificate supersedes the Certificate of Correction issued March 17, 2009.

Signed and Sealed this

Seventh Day of April, 2009

JOHN DOLL
*Acting Director of the United States Patent and Trademark Office*